US005893018A

United States Patent [19]

De Bock et al.

[11] Patent Number: 5,893,018

[45] Date of Patent: Apr. 6, 1999

[54] SINGLE-PASS, MULTI-COLOR ELECTROSTATOGRAPHIC PRINTER WITH CONTINUOUS PATH TRANSFER MEMBER

[75] Inventors: Jan Julien Irma De Bock, Beveren; Etienne Marie De Cock, Edegem; Daniel Frans Maria Van De Velde, Kontich; Patrick Billet, Meise, all of Belgium

[73] Assignee: Xeikon N.V., Mortsel, Belgium

[21] Appl. No.: 807,061

[22] Filed: Feb. 27, 1997

Related U.S. Application Data

[63] Continuation-in-part of Ser. No. 756,117, Nov. 25, 1996.

[60] Provisional application No. 60/022,848, Jul. 21, 1996.

[30] Foreign Application Priority Data

Dec. 13, 1996 [EP] European Pat. Off. ..... 96309131

[51] Int. Cl.[6] ..... G03G 15/01

[52] U.S. Cl. ..... 399/302; 399/306; 399/307

[58] Field of Search ..... 399/94, 298, 299, 399/302, 306–308

[56] References Cited

U.S. PATENT DOCUMENTS

| | | | |
|---|---|---|---|
| 2,990,278 | 6/1961 | Carlson . | |
| 3,862,848 | 1/1975 | Marley . | |
| 3,893,761 | 7/1975 | Buchan et al. . | |
| 3,957,367 | 5/1976 | Goel . | |
| 4,095,886 | 6/1978 | Koeleman . | |
| 4,183,658 | 1/1980 | Winthaegen . | |
| 4,341,455 | 7/1982 | Fedder . | |
| 4,453,820 | 6/1984 | Suzuki | 399/308 |
| 4,541,709 | 9/1985 | Kampschreur . | |
| 4,682,880 | 7/1987 | Fuji et al. . | |
| 4,708,460 | 11/1987 | Langdon . | |
| 4,796,048 | 1/1989 | Bean . | |
| 4,992,833 | 2/1991 | Derrmiggio | 399/308 |
| 5,233,397 | 8/1993 | Till . | |
| 5,351,114 | 9/1994 | Matsuno | 399/307 |
| 5,428,430 | 6/1995 | Aslam et al. | 399/307 |

*Primary Examiner*—William Royer
*Attorney, Agent, or Firm*—Baker & Botts, L.L.P.

[57] ABSTRACT

A single pass, multi-color electrostatographic printer includes a transfer member which is driven along a continuous path. Several toner images of different colors are electrostatically deposited in powder form in registration with each other on the transfer member to form a multiple toner image thereon. A substrate is fed into contact with the transfer member. The multiple toner image is thereby transferred to at least one face of the substrate. The printer includes heaters for heating the multiple toner image on the transfer member in advance of the transfer of the image to the substrate and cooling devices for cooling the transfer member following the transfer of the multiple toner image therefrom to the substrate to a temperature below the glass transition temperature $T_g$ of the toner, prior to the deposition of further toner images on the transfer member.

28 Claims, 17 Drawing Sheets

SINGLE-PASS, MULTI-COLOR ELECTROSTATOGRAPHIC PRINTER WITH CONTINUOUS PATH TRANSFER MEMBER

This is a continuation-in-part application of co-pending allowed application Ser. No. 08/756,117, filed Nov. 25, 1996.

This application claims the benefit of U.S. Provisional Application Ser. No. 60/022,848, filed Jul. 31, 1996.

BACKGROUND OF THE INVENTION

This invention relates to a printer, in particular to a single pass, multi-colour electrostatographic printer, and to a method of single-pass multi-colour electrostatographic printing.

Electrostatographic printers are known in which a toner image is electrostatically formed on a rotatable endless surface, such as a belt or a drum, and then ultimately transferred to a receiving material, which is usually in the form of paper sheets or a web.

U.S. Pat. No. 4,796,048 (Bean/Xerox Corporation) describes a copying apparatus in which a monochrome liquid toner image is formed on a photoconductor and then deposited on a transfer member in the form of a belt. The image is transferred from the belt to a substrate. In one described embodiment, the solvent in the liquid toner is removed from the toner image while it is carried on the belt by the application of infra-red radiation and a vacuum. The image is then transferred to the substrate by heat and pressure and the belt is then optionally cooled before a further image is deposited thereon.

International patent application WO92/10793 (Spectrum Sciences BV) describes an imaging apparatus in which a liquid toner image is formed on a single photoconductor and then deposited on a transfer member in the form of a heated transfer drum and transferred from there to a substrate. The surface of the heated transfer drum may be cooled in advance of the deposition of the image. The multiple image is deposited on the transfer drum in steps, that is the transfer drum is rotated once for each colour image being deposited. Cooling of the drum surface is necessary in advance of the deposition of each next colour image in order to avoid back transfer of the toner to the photoconductor. Step-by-step deposition is slow, in particular because of a speed limitation which is inherent in the image writing system. Where, for example, four colour images are deposited, the overall printing speed can be no faster than 25% of the image writing speed. Also, the apparatus described by Spectrum introduces the risk of contamination of one toner developing unit by toner of another colour. As a consequence, the apparatus described by Spectrum includes a very thorough cleaning system for the photoconductor.

In any event, we prefer to avoid the use of liquid toners as described in Bean and Spectrum referred to above, especially where such toners are based on non-aqueous solvents such as Isopar (Trade Mark), which is mainly decane. Such solvents may not freely be released into the atmosphere for environmental reasons and it is therefore necessary to include special arrangements to avoid such release.

Copiers and printers have been proposed which make use of toner in powder form. In U.S. Pat. No. 5,059,990 (Abreu et al./Xerox Corporation) for example, a multi-pass multi-colour printer is described in which a sheet of receiving material is moved in a recirculating path into contact with a single toner image carrying photoconductive belt, to which powder toner images of various colours are applied in turn. Such multiple-pass printers introduce considerable difficulties in the registration of the various toner images on the receiving material and also suffer from similar speed limitations to those referred to above in connection with the apparatus described by Spectrum.

U.S. Pat. No. 5,119,140(Burkes et al./Xerox Corporation) describes a printer in which a number of powder toner images are deposited in turn onto an image receiving member to form a multiple toner image thereon. The multiple toner image is thereafter transferred by electrostatic means to a plain paper substrate. The efficiency of the electrostatic transfer to the substrate is dependant upon the nature and condition of the substrate and may not be 100% effective. For this reason Berkes et al. require the provision of a device for cleaning the image receiving member before a further image is deposited thereon.

In European patent application EP 220663A (Colorocs Corporation), a single pass, multi-colour printer is described in which a multiple toner image is formed on a transfer belt and then transferred to a substrate, normally in the form of a sheet of paper. The multiple toner image is formed on the transfer belt by sequential transfer from a photoreceptor belt onto which toner images of different colours are formed by electrostatographic means. In order to form the multiple toner image, the transfer belt has to circulate a number of times, corresponding at least to the number of different colour toner images, before the multiple toner image can be transferred to the paper sheet. This construction introduces considerable problems in ensuring accurate registration of the different coloured images and speed limitations as discussed above in connection with the apparatus described by Abreu et al.

In U.S. Pat. No. 5,455,668 (De Bock et al./Xeikon NV) a single-pass multi-colour printer is described in which a substrate in the form of a web passes a plurality of toner image forming stations where images of different colours are simultaneously transferred thereto in register.

Once one or more toner images have been transferred to the substrate, it is necessary to fix the images thereon. A number of fixing techniques are known, such as radiant heat fixing, and hot or cold pressure fixing. Radiant fixing has advantages of not introducing contact with the substrate but consumes significant energy, its efficiency is dependant upon the nature and characteristics of the substrate, questions may arise concerning the evaporation of environmentally unacceptable compounds which may be present in the substrate and the dry substrate may suffer from dimensional instability resulting in wrinkling and can become easily charged resulting, for example, in stacking problems. Where the thermal expansion coefficients of the substrate and the toner are significantly different, the use of radiant fixing can lead to distortion of the final printed image. Furthermore, radiant fixing is less suitable for substrates in the form of cut sheets as opposed to a web, since the position of the substrate path is more difficult to ensure. Pressure roller fixing on the other hand, while consuming less energy, is a contact method and the rollers used have a relatively short life-time. Furthermore, pressure roller fixing often requires the use of liquid release agents, such as silicone oils, while it is preferred to reduce the level and variety of consumable materials used in the printer.

SUMMARY OF THE INVENTION

It is an object of the present invention to provide an electrostatographic single-pass multi-colour printer in which the aforesaid disadvantages are overcome.

According to a first aspect of the invention there is provided a single pass, multi-colour electrostatographic printer comprising:

a transfer member;

drive means for moving the transfer member along a continuous path;

electrostatic deposition means for depositing a plurality of toner images of different colours in powder form in register with each other onto the transfer member to form a charged multiple toner image thereon;

substrate feed means to feed a substrate along a substrate path into contact with the transfer member, whereby the multiple toner image is transferred to at least one face of the substrate;

heating means for heating the multiple toner image on the transfer member in advance of the transfer of the multiple toner image to the substrate; and cooling means for cooling the transfer member following the transfer of the multiple toner image therefrom to the substrate to a temperature below the glass transition temperature $T_g$ of the toner, prior to the deposition of further toner images onto the transfer member.

According to a second aspect, the invention also provides a method of single pass, multi-colour electrostatographic printing comprising:

moving a transfer member along a continuous path;

electrostatically depositing a plurality of toner images of different colours in powder form in register with each other onto the moving transfer member to form a charged multiple toner image thereon;

feeding a substrate along a substrate path into contact with the moving transfer member, whereby the multiple toner image is transferred to at least one face of the substrate;

heating the multiple toner image on the moving transfer member in advance of the transfer of the multiple toner image to the substrate; and cooling the transfer member following the transfer of the multiple toner image therefrom to the substrate, to a temperature below the glass transition temperature $T_g$ of the toner, prior to the deposition of further toner images on the transfer member.

The heating means for the transfer member may comprise infra-red radiant heating means, although other forms of heating including HF radiation, induction heating, convection heating and conduction heating, for example the use of heated rollers, are also suitable. The temperature to which the multi-colour image on the transfer member is heated is important. In particular, the surface of the toner image should contact the substrate at a temperature above the fluid temperature of the toner, so as to ensure mixing of the toner particles of different colours, complete transfer of the mixed multiple toner image to the substrate and the fixing of the image on the substrate. The fluid temperature is the temperature at which the viscosity of the toner falls below 50 Pa s, such as from 10 Pa s to 40 Pa s. This temperature to which the multiple toner image is heated is above the glass transition temperature of the toner but below the degradation temperature thereof, that is below the temperature at which irreversible changes occur in the toner composition leading to a significant change in its spectral properties. The fluid temperature is typically above 150° C., even above 200° C., depending upon the composition of the toner. Viscosity is typically measured by the use of a cup viscometer (Ford cup, Shell cup or Zahn cup). ASTM D-1200 is an accepted standard for the measurement of viscosities of printing inks. Laray and Churchill falling rod viscometers may also be used.

The cooling means for the transfer member may comprise convection or conduction cooling devices, for example, means for bringing the transfer member into contact with cool air, a fan directing cool air onto the surface of the transfer member or a cooled roller over which the transfer member passes. The temperature to which the transfer member is cooled prior to the deposition of further multi-colour toner image thereon is also important. In particular, the surface of the transfer member should be reduced to a temperature below the glass transition temperature $T_g$ of the toner, such as to about room temperature.

The transfer member plays the role of transferring the multiple toner image to the substrate. It is not necessary therefore that the transfer member has a photoconductive surface. Indeed, the need to heat and cool the transfer member in the apparatus according to the invention means that the use of conventional photoconductor materials is to be avoided, since the photoconductive properties of such materials are sensitive to temperature changes.

While not wishing to be bound by theory, it is our understanding that it is generally preferred to transfer toner images from a material of relatively low surface energy to one of relatively high surface energy. This reduces the possibility of toner particles shearing during transfer which reduces the efficiency of the transfer process and leaves residual toner on the donor surface. Ideally therefore, the surface energy of the donor surface should be lower than that of the receiving surface. This can be achieved for the transfer of the image from the transfer member to the substrate, since the surface energy of the substrate, such as paper, is generally more than 45 dyne/cm. The transfer process is more efficient when the donor surface is at a higher temperature than the receiving surface. Thus the present invention requires heating of the toner image on the transfer member so as to maximise the efficiency of the transfer to the substrate.

The transfer member may comprise an outer surface formed of a material having a low surface energy, for example silicone elastomer (surface energy typically 20 dyne/cm), polytetrafluoroethylene, polyfluoralkylene and other fluorinated polymers. The transfer member is preferably in a form having a low mass, so that the surface thereof can be easily heated prior to the transfer of the multiple toner image to the substrate and easily cooled after transfer before the transfer thereto of a further multiple toner image from the primary belt. For this reason, while the transfer member can be in the form of a transfer roller or drum, it is preferably in the form of a transfer belt, for example an endless metal belt of 40 $\mu$m thickness coated with 40 $\mu$m thickness silicone rubber.

By specifying that the plurality of toner images of different colours are electrostatically deposited onto the moving transfer member to form a charged multiple toner image thereon, we mean that either (Option 1) the multiple toner image is firstly formed on another member and then deposited as such onto the transfer member, or (Option 2) a plurality of toner image deposition devices operate sequentially at different locations along the transfer member path to deposit toner images on the transfer member. In the latter alternative, the operation of the toner image deposition devices is so controlled in relation to each other as to ensure the desired registration of the various different images.

Thus, according to one embodiment of Option 1 of the invention, the transfer member is an intermediate transfer member and the means for forming a multiple toner image on the transfer member comprises:

a primary transfer member;

means for guiding the primary transfer member past a set of toner image producing stations whereby a plurality of toner images of different colours are formed on the primary transfer member in register with each other to form the multiple toner image on the primary transfer member, the intermediate transfer member being in contact with the primary transfer member downstream of the image producing stations, whereby the multiple toner image is electrostatically transferred from the primary transfer member to be deposited on the cooled intermediate transfer member. In this embodiment, the primary transfer member is preferably constituted by a primary belt.

The primary belt may have, for example, a toner image carrying surface formed of an electrically non-conductive material. The electrically non-conductive material is preferably selected from polyethylene terephthalate, silicone elastomer, polyimide (such as KAPTON—Trade Mark), and mixtures thereof. The primary belt may consist entirely of this material, or be in the form of a base material coated with such an electrically non-conductive material. The base material of the primary belt may be a metal, such as stainless steel, a polyimide, a polyvinyl fluoride, a polyester, and mixtures thereof. Polyester has the advantage of good mechanical and electrical characteristics and of being less sensitive to humidity.

The transfer of the multiple toner image from the primary belt to the intermediate transfer member is more difficult to achieve if the intermediate transfer member has a relatively low surface energy. While there would therefore be an advantage in heating the primary belt between the last image producing station and its contact with the intermediate transfer member, there is a risk of the temperature becoming too high. This problem can be avoided according to the present invention, by transferring the multiple toner image from the primary belt to be deposited on the intermediate transfer member by electrostatic means or by a combination of electrostatic means and heat. This has an added advantage of reducing the risk of toner-toner shearing at those portions of the image where toner of one colour lies directly over toner of another colour.

Drive to the primary belt is preferably derived from the drive means for the intermediate transfer member, by making use of adherent contact between the primary belt and the intermediate transfer member causing the primary belt and the intermediate transfer member to move in synchronism with each other. Adherent contact between the primary belt and the image producing stations may be used to ensure that the image producing stations move in synchronism with the primary belt. The primary belt preferably passes over a guide roller positioned in opposition to the intermediate transfer member to form a nip or contact region therebetween.

Means for cleaning the primary belt, and optionally also means for cooling the primary belt, are preferably provided after contact with the intermediate transfer member.

Means for tensioning the primary belt may be provided in order to ensure good registration of the toner images thereon and to improve the quality of transfer of the multiple toner image therefrom to the intermediate transfer member. Means for controlling the transverse position and movement of the primary belt may also be included.

Each toner image producing station may comprise rotatable endless surface means, means for forming an electrostatic latent image on the rotatable endless surface means, means for developing the electrostatic image to form a toner image on the rotatable endless surface means and transfer means for transferring the toner image onto the primary belt. The rotatable endless surface means is preferably a drum having a photosensitive surface. The transfer means may comprise a transfer roller located at the face of the primary belt opposite the drum, or a corona transfer device. When the transfer means is a transfer roller, the primary belt is in contact with the drum over a contact angle of less than 5°, measured at the axis of the rotatable endless surface means, e.g. substantially tangential contact. However, when the transfer means is a corona transfer device, the primary belt is preferably in contact with the drum over a contact angle of more than 5° so that adherent contact between the primary belt and the rotatable endless surface means enables drive to be reliably transmitted from the primary belt to the drum. The reliability of this transfer is enhanced by tensioning the primary belt.

Dry-development toners essentially comprise a thermoplastic binder consisting of a thermoplastic resin or mixture of resins including colouring matter, e.g. carbon black or colouring material such as finely dispersed pigments or soluble dyes.

The mean diameter of dry toner particles for use in magnetic brush development is conventionally about 10 $\mu$m (ref. "Principles of Non Impact Printing" by Jerome L. Johnson-Palatino Press Irvine Calf., 92715 U.S.A. (1986), p. 64–85). For high resolution development the mean diameter may be from 1 to 5 $\mu$m (see e.g. British patent specification GB-A2180948 and International patent specification WO-A-91/00548).

The thermoplastic resinous binder may be formed of polyester, polyethylene, polystyrene and copolymers thereof, e.g. styrene-acrylic resin, styrene-butadiene resin, acrylate and methacrylate resins, polyvinyl chloride resin, vinyl acetate resin, copoly(vinyl chloride-vinyl acetate) resin, copoly(vinyl chloride-vinyl acetate-maleic acid) resin, vinyl butyral resins, polyvinyl alcohol resins, polyurethane resins, polyimide resins, polyamide resins and polyester resins. Polyester resins are preferred for providing high gloss and improved abrasion resistance. Such resins usually have a glass transition point of more than 45° C., usually above 54° C. The presence of other ingredients in the toner particles, such as the colorant, usually have no significant effect upon the glass transition temperature. The volume resistivity of the resins is preferably at least $10^{13}$ Ω-cm.

Suitable toner compositions are described in European patent applications EP-A-601235, and EP-A-628883 and International patent applications WO 94/27192, 94/27191 and 94/29770 (all Agfa-Gevaert NV). The glass transition temperatures of most common toner compositions are similar at about 55° C. and a melting point within the range of 90° to 155° C.

We prefer to use toners having a composition comprising a thermoplastic binder and from 10% to 50% by weight, based on the weight of the toner composition, of a pigment. We also prefer that the toner composition in powder form has a weight average particle size of between 0.5 $\mu$m and 5 $\mu$m, preferably between 1 $\mu$m and 4 $\mu$m. The use of toner compositions having a higher level of pigment therein enables images with a higher density to be printed. Alternatively, for the same image density, smaller toner particles can then be used. The use of smaller toner particles has the advantage that the height of the toner image above the surface of the substrate is lower. The advantages of a lower toner image height include (a) irregularities in the surface of the substrate have less of an effect upon the gloss of the image, (b) the total usage of toner is reduced—this is important because the cost of the toner may be significant in the total cost of the printed product, (c) the tendency of the printed page to curl is reduced, (d) the stacking of printed pages, for example in the preparation of a book, is more even, and (e) there is a flatter feel to the printed page, a characteristic which is of advantage to some users.

The use of a transfer belt has other advantages over, for example, the use of a transfer roller. One run or section of the transfer belt may be heated while the other run is cooled. In this manner, the temperature of the transfer belt at its point of contact with the substrate can be higher than its temperature at its point of contact with the primary belt, leading to an improvement in toner transfer and reducing the chances of offset ghost image effects. For the production of glossy images, it is advisable that the surface of the intermediate transfer member be as flat as possible. In particular it is advantageous if the surface roughness $R_a$ is less than 0.2 $\mu$m. For the production of matt images, the surface roughness may be higher. The use of a transfer belt in place of a transfer roller as the intermediate transfer member enables the contact area between this member and the primary belt to be greater. This enables the adherent contact therebetween to be improved thereby providing a more reliable transmission of drive from the intermediate transfer member to the primary belt without increase in pressure.

Another aspect of the present invention is a method for the transfer of a toner image in powder form from a transfer member to the substrate, comprising:

(1) heating the toner image to a temperature sufficient to reduce the viscosity thereof to less than 50 Pa s;
(2) bringing the transfer member carrying the toner image into contact with the substrate;
(3) cooling the transfer member to a temperature below the glass transition temperature $T_g$ of the toner while the transfer member remains in contact with the substrate; and
(4) thereafter separating the transfer member from the substrate.

The multiple toner image may be heated to a temperature of more than the glass transition temperature $T_g$, e.g. more than 200° C., but below the degradation temperature of the toner.

Due to the fact that dry toner images have a high thickness (sometimes more than 10 $\mu$m), the appearance of such images is sometimes unnatural and non-uniform and these images usually have a non-uniform colour saturation. While this appearance is acceptable for many applications, it is sometimes desired to provide an image having a different appearance or finish. By the term "finish" in the context of the present invention, we mean either a surface characteristic which is glossy, i.e. highly reflective, and/or which provides high saturation of colours, this usually being achieved by reducing the scattering of light from the surface of the printed article, or both such characteristics. For example, a glossy appearance is especially desirable where the receiving material itself has a glossy surface. A higher degree of colour saturation can be very desirable in high quality print work.

The transfer member may be positioned in opposition to a pressure roller to form a transfer nip therebetween, through which the substrate path passes. In this arrangement, it is possible to provide, downstream of the transfer nip, a glossing roller positioned in opposition to the pressure roller to form a supplementary glossing nip through which the substrate passes. The substrate passes through this glossing nip at a temperature determined by the temperature of the substrate, which is much less than the temperature of the toner at the transfer nip.

It has been proposed to provide glossy images by the use of a toner which incorporates a glossing agent, or by the application of a transparent glossing layer over the toner image. However, these methods are costly in terms of consumables.

In U.S. Pat. No. 5,521,688 (Moser/Xerox Corporation) it has been proposed to provide glossy images by passing the substrate carrying the toner images through an oven heater to fix the images and then through a pair of glossing rollers operating at approximately the same temperature as the oven.

U.S. Pat. No. 5,319,429 (Fukuchi et al./Konica Corporation) describes a colour printer having a fixer for fixing a toner image on a recording sheet, which includes an endless polyimide heat belt which is supported by a heat roller and a separation roller, and an endless conveyance belt which is supported by a pressure roller and another separation roller. The endless heat belt and the conveyance belt are pressed together over part of their length, so that a nip region is created between the first pair of rollers and the second pair. The belts have glossy surfaces.

It would be desirable to use one and the same device to fix the toner images and to provide them with the desired gloss. However, contact-less fixing devices are unable to provide a uniform glossing effect, while we have found that the use of known heated rollers or heated belt fixing devices suffer from toner offset problems and do not provide sufficient control over the gloss and colour saturation of the images. In particular such known devices exhibit limited process parameters, with a narrow window of optimum performance.

It is desirable that un-fixed toner images formed on a substrate can be fixed to the substrate and provided with a desirable level of gloss in one single device, while widening the range of operating conditions without risk of offset occurring. We have found that this can be achieved by the use of a contact zone through which the substrate passes, wherein the transfer member is cooled within the contact zone and/or is heated adjacent the exit of the contact zone to a temperature above the glass transition temperature $T_g$ of the toner.

Thus, the transfer member may be positioned in face-to-face pressure contact with a reaction surface to form a contact zone therebetween, extending continuously from an entrance to an exit, the heating means being positioned for heating the transfer member adjacent the entrance to a temperature above the glass transition temperature $T_g$ of the toner, and the cooling means being positioned for forcibly cooling the transfer member intermediate the entrance and the exit to a temperature below the glass transition temperature $T_g$ of the toner.

Means may be provided for applying pressure between the transfer member and the reaction surface intermediate the entrance and exit.

While not wishing to be bound by theory, we believe that, where toner images are fixed on a substrate by means of a heated surface such as a roller or heated belt, there is a risk of molten toner becoming transferred to the heated surface as the substrate separates therefrom, to be subsequently deposited on a following section of substrate, resulting in the phenomenon of "ghost images". Even if the characteristics of the heated surface are so chosen as to reduce the risk of such "hot-offset", the separation of the heated surface from the substrate tends to distort the toner particles into a somewhat non-flat shape, leading to low gloss and colour saturation. Forcibly cooling the substrate on the other hand, while pressure is applied thereto, tends to flatten the toner particles, leading to an increase in colour saturation or alternatively enabling the quantity of toner used during printing to be reduced by, for example, 20% to 30%. Thus, it is advantageous according to the invention to cool the transfer member to a temperature below the glass transition temperature $T_g$ of the toner while the transfer member is in pressure contact with the reaction surface. There is therefore a temperature gradient within the contact zone, from a temperature above the glass transition temperature $T_g$ of the toner adjacent the entrance of the contact zone to a temperature below the glass transition temperature $T_g$ of the toner before the exit from the zone.

The heating means may comprise a heating surface in contact with the transfer member, such as a roller, or a heated stationary body over which the transfer member passes. Heating may be achieved, for example, by passing a heating fluid (e.g. steam or hot oil) at an elevated temperature through the roller or stationary body, or by the provision of radiant heating means positioned within the roller or stationary body. It is also possible to use radiant heating means for directly heating the transfer member, and this may be especially beneficial where the transfer member is formed primarily of heat non-conductive material. Generally, the transfer member will be heated from the side thereof opposite from its contact with the reaction surface and the substrate. Generally, the transfer member contacts the substrate with a dry surface, i.e. there is no need to apply a liquid release agent to the transfer member surface.

Second heating means may be provided for heating the transfer member adjacent the exit of the contact zone to a temperature above the glass transition temperature $T_g$ of the toner. The advantage of this second heating is to raise the temperature of the flattened surface of the toner, thereby lowering its surface energy. This eases the release of the toner from the transfer member, without raising the temperature of the bulk of the toner so much that the toner loses its flatness as it separates from the transfer member or even breaks down leaving toner deposited on the transfer member. The second heating means may be constructed in a similar manner to the heating means at the entrance to the contact zone, for example as a second heated roller over which the transfer member passes. Where second heating means in the form of a second heated roller is provided adjacent the exit of the contact zone, and the transfer member is in the form of a transfer belt, it is preferable to arrange the geometry such that the transfer belt wraps partially around the second heated roller within the contact zone, to enhance the heating effect thereof.

Preferably both the application of pressure in the contact zone and the heating of the transfer member adjacent the exit of the contact zone are used together to gain maximum advantage from the invention.

The cooling means used in the contact zone may comprise a cooling surface in contact with the transfer member, such as a cooling roller over which the transfer member passes. Cooling may be achieved, for example, by passing a cooling fluid (e.g. water at room temperature or reduced temperature) through the roller or stationary body. It is also possible to direct cold or cooled air directly at the transfer member. Generally, the transfer member will be cooled from the side thereof opposite its contact with the reaction surface and the substrate.

The heat extracted from the transfer member by the cooling means may be used to pre-heat the transfer member on its return run, in advance of the heating which takes place at the entrance to the contact zone. Thus, the cooling means may be constituted by the cold region of a heat pump, the hot region of which is in contact with the transfer member on its return run. Alternatively, heat extracted from the transfer member by the cooling means may be used to pre-heat the substrate.

The transfer member may comprise a heat conductive backing carrying a coating of non-abhesive material, preferably a silicone rubber. In any event, the transfer member should have a low thermal capacity, to ensure the rapid heating and cooling thereof. Such rapid temperature changes enable the apparatus to be smaller in size than would otherwise be necessary. The transfer member should also be formed primarily of a heat conductive material, if heating from the "back-side" thereof is to be used. A heat-conductive transfer member has the advantage of distributing a more even temperature, as "hot spots" are avoided. The transfer member, or at least the coating carried thereon, should be seamless, especially if substrates in web-form are to be used. The transfer member is preferably impermeable. The reaction surface is also preferably impermeable. The use of an impermeable transfer member and reaction surface leads to a particular advantage of the present invention. Although the substrate temperature rises in the contact zone, even to above 100° C., any moisture in the substrate cannot escape and condenses on the transfer member to be returned to the substrate by the second heating means. The disadvantages of open radiant fixing referred to above, resulting from the substrate becoming too dry, are therefore avoided.

The contact zone extends from the initial point of contact between the transfer member and its reaction surface to the point of separation between the transfer member and its reaction surface. It is important to maintain contact within the contact zone, although the pressure need not be constant throughout the zone. The pressure may be generated by virtue of the geometry of the transfer member and its reaction surface, but it is helpful to provide a pair of intermediate pressure rollers located one on either side of the extended contact zone, upstream of the cooling means. The pressure which is applied intermediate the entrance and exit of the contact zone is preferably applied at the same region as, or close to, the region of application of the forced cooling. It is also preferred to apply pressure between the transfer member and the reaction surface adjacent the entrance to the contact zone. Thus, in the contact zone at least two pressure points are realised, one adjacent the entrance and the other intermediate the entrance and the exit. We have found that an average contact pressure at the pressure points of from 2 to 20 $N/cm^2$, such as from 5 to 10 $N/cm^2$ is preferred, depending on the absorbency of the substrate, the temperature and the viscosity of the toner.

Where the cooling means is constituted by a cooling roller, this cooling roller should be so positioned as to ensure more than tangential contact between the cooling roller and its associated transfer member. By ensuring that the transfer member partially wraps around its associated cooling roller, the forcible cooling effect is thereby obtained.

The toner particle image may be carried on one face only of the substrate (i.e. a "simplex" substrate). For example, the substrate may comprise adhesive labels carried on a plastics material backing sheet. For such "simplex" substrates, the reaction surface may be constituted by either a movable reaction member such as a further belt, or by a stationary body. Where a movable reaction member is used as the reaction surface for "simplex" substrates, it need not be heated at all. Indeed, forcibly cooling the movable reaction member, even from the entrance of the contact zone, helps to avoid distortion of the substrate. Alternatively, the reaction surface may be constituted by the surface of a stationary body, which may include means for cooling the stationary body.

The substrate may be in the form of a web, but the invention is equally applicable to substrates in sheet form, the device then being provided with suitable sheet feeding means. The geometry of the device may be such as to define a substantially straight path for the substrate. This can be of advantage for heavier, especially thicker or less flexible, substrates.

The transfer member may be driven directly, for example by applying drive to a heating roller at the entrance of the contact zone, to a second heating roller at the exit of the contact zone or to an intermediate pressure roller. It is important to arrange for the transfer member to be driven in synchronism with movement of the substrate, and with the movable reaction member where present, to prevent slippage which may distort the toner image. Alternatively, where the substrate is in the form of a web, the transfer member, and the movable reaction member where present, may be driven by movement of the web itself, means being provided to compensate for the torque resistance of the transfer member. This arrangement ensures that the substrate web and the transfer member move in synchronism.

The transfer member may return from the exit of the contact zone to the entrance thereof via an adjustable tensioning and alignment roller. Where an intermediate pressure roller is in contact with the transfer member within the contact zone, this intermediate pressure roller may be in heat exchange relationship with the alignment roller, for example by way of a heat exchange fluid passing through hollow interiors of both rollers. The energy requirements of the device can thereby be reduced.

The printer according to the invention may also be part of an electrostatic copier, working on similar principles to those described above in connection with electrostatic printers. In copiers however, it is common to expose the rotatable endless surface exclusively by optical means, directly from the original image to be copied.

The substrate is preferably in the form of a web. Web cutting means, optionally together with a sheet stacking device may be provided downstream of the intermediate transfer member. Alternatively, the web is not cut into sheets, but wound onto a take-up roller. The web of substrate may be fed through the printer from a roll. If desired, the substrate may be conditioned (i.e. its moisture content adjusted to an optimum level for printing), prior to entering the printer.

The substrate may alternatively be in the form of cut sheets, or other articles of suitable shape. The present invention is particularly of advantage in the printing of substrates of significant thickness and rigidity.

Furthermore, embodiments of the present invention have the advantage, in comparison to those printing devices in which a toner image is electrostatically transferred directly to the substrate, that the electrical condition of the substrate is less critical. There is, for example, no need to condition the substrate to adjust its moisture content to within a specified range, nor to condition the environment of the printer. This feature represents a useful advantage over the printers disclosed, for example, in U.S. Pat. No. 5,455,668 referred to above. The range of substrate types which can be used is also increased, to include for example substrates formed of synthetic materials, of flimsy materials or of irregular shape.

Means for heating the substrate are preferably provided in advance of contact with the intermediate transfer member. This may be achieved by the use of heating means selected from infra-red and high-frequency radiant heating means, convection heating means, conduction heating means, such as heated rollers, and other known heating means.

It may be desired to print a toner particle image on both faces of the substrate (i.e. "duplex" printing). The printer according to the invention may be adapted for duplex printing, by comprising:

electrostatic deposition means for depositing a second such multiple toner image on a second transfer member, the substrate feed means being adapted to feed a substrate along a substrate path into contact with the second transfer member, whereby the second multiple toner image is transferred to the opposite face of the substrate; and means for heating the second multiple toner image on the second transfer member in advance of the transfer of the second multiple toner image to the substrate; and means for cooling the second transfer member following the transfer of the second multiple toner image therefrom to the substrate prior to the deposition of further toner images on the second transfer member.

The first and second transfer members may be positioned in opposition to each other to form a transfer nip therebetween, through which the substrate path passes.

The second transfer member may be a second intermediate transfer member and the means for forming a second multiple toner image on the second transfer surface may then comprise:

a second primary transfer member;

means for guiding the second primary transfer member past a second set of toner image producing stations whereby a second plurality of toner images of different colours are transferred to the second primary transfer member in register with each other to form the second multiple toner image on the second primary transfer member, the second intermediate transfer member being in contact with the second primary transfer member downstream of the second set of image producing stations.

In this embodiment, the first and second intermediate transfer members may be positioned in opposition to each other to form a nip or contact region therebetween, through which the substrate path passes. Drive to the second intermediate transfer member may be derived from the first intermediate transfer member or may be derived from a separate drive motor, controlled to drive the second intermediate transfer member in synchronism with the first intermediate transfer member.

Alternatively, the first and second intermediate transfer members are spaced from each other, each being provided with a respective counter roller to define a nip or contact region through which the substrate passes. When the substrate is in the form of a web, the substrate may be in contact with a position sensing device between the first and second intermediate transfer members, the output of which sensing device can be used to control the drive motors of the respective intermediate transfer members to ensure that the intermediate transfer members run at the same mean speed.

Where the toner image is to be transferred to a substrate in a contact zone defined by a reaction surface in face-to-face contact pressure with the transfer member, as described above, and duplex printing is desired, the reaction surface is preferably constituted by a further transfer member which is also heated adjacent the entrance to a temperature above the glass transition temperature $T_g$ of the toner, and cooled intermediate the entrance and the exit to a temperature below the glass transition temperature $T_g$ of the toner.

In an embodiment of Option 2 of the invention, the primary belt and the intermediate transfer member are constituted by one and the same member. The transfer member may be constituted by a belt and there are provided means for guiding the belt past a set of toner image producing stations whereby a plurality of toner images of different colours are transferred to the belt in register with each other to form the multiple toner image on the belt, and the substrate feed means are arranged to feed a substrate along a substrate path into contact with the belt.

In order to reduce energy loss to the environment, we prefer that the means for heating the toner image on the transfer member is in heat exchange relationship with the means for cooling the transfer member after transfer. For example, the means for heating the multiple toner image on the transfer member comprises a pre-heating roller and the means for cooling the transfer member comprises a pre-cooling roller, the pre-heating roller and the pre-cooling roller being in heat exchange relationship with each other. This heat exchange relationship can be achieved for example by each of the heating and cooling rollers being hollow rollers through which a heat exchange fluid, such as water, is caused to flow. In this way heat extracted by the cooling roller is transferred to the heating roller and contributes to the heating of the toner image on the transfer member. We are aware of European patent application EP 0 399 794 (Delphax Systems) (corres. to U.S. Pat. No. 5,012,291) which describes a powder transport, fusing and imaging apparatus in which a writing belt having a low free surface energy moves in a cyclic path to transfer monochrome toner from a first location to a second location at a different temperature, and counter moving portions of the belt exchange heat with each other so that minimum energy is lost to the environment. The monochrome toner image is transferred to the belt at the first location and transferred from the belt to a substrate at the second location. However, Delphax describes achieving the heat exchange by contact between opposing runs of the belt, which we prefer to avoid, since this introduces undesirable friction, heat and wear.

In order not to disturb the multiple toner image on the transfer member between the deposition of the image thereon and the transfer of the image to the substrate, we prefer that the surface of the transfer member which carries the image is free of contact with any other member. Thereby, undesirable transfer of the image, or a part thereof, from the transfer member is avoided. Thus, where for example the transfer member is in the form of a belt, rollers or other guide means, contact the belt on the surface thereof opposite that carrying the image, at least between the deposition of the image and its transfer to the substrate.

BRIEF DESCRIPTION OF THE DRAWINGS

The invention will now be further described, purely by way of example, by reference to the accompanying drawings in which.

Figure 1:
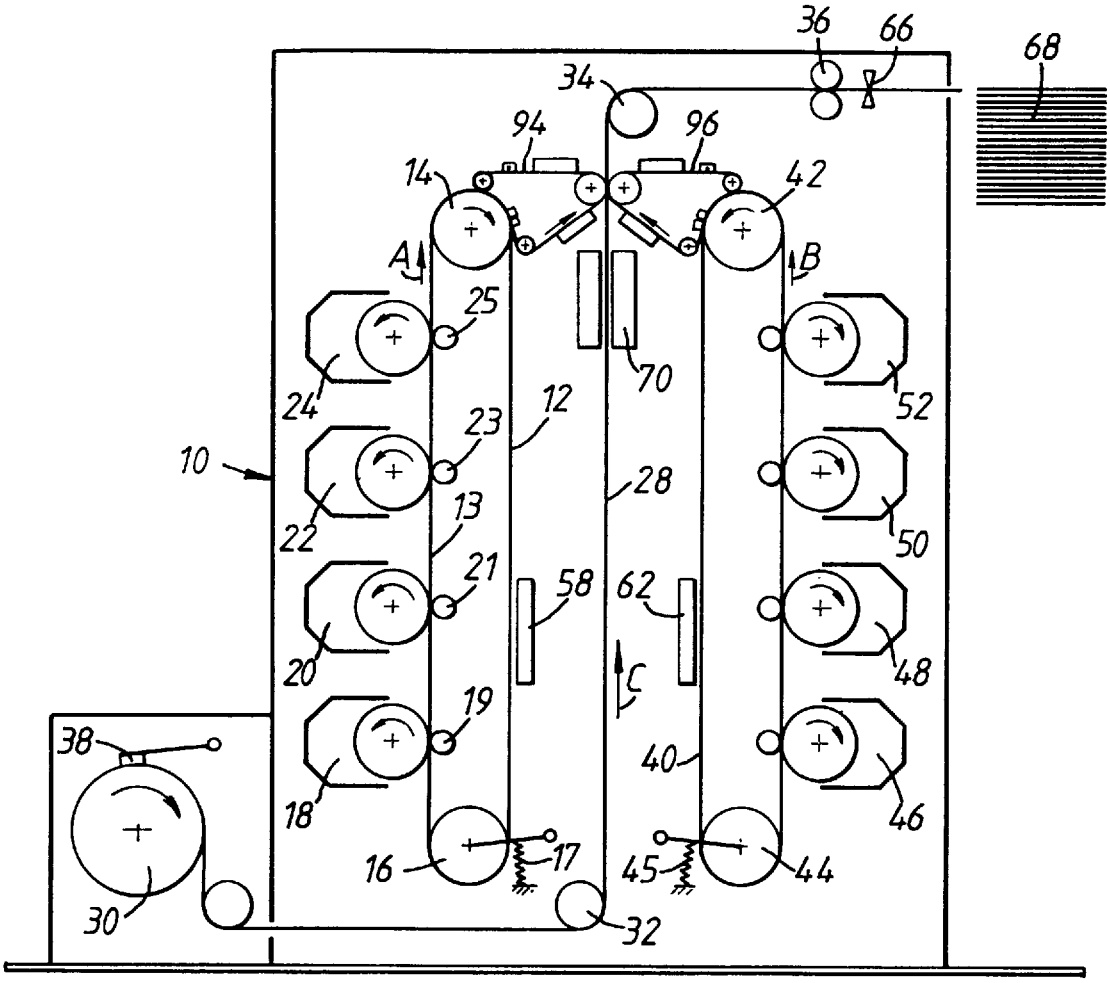
FIG. 1 shows a duplex printer according to the invention.
Figure 10:
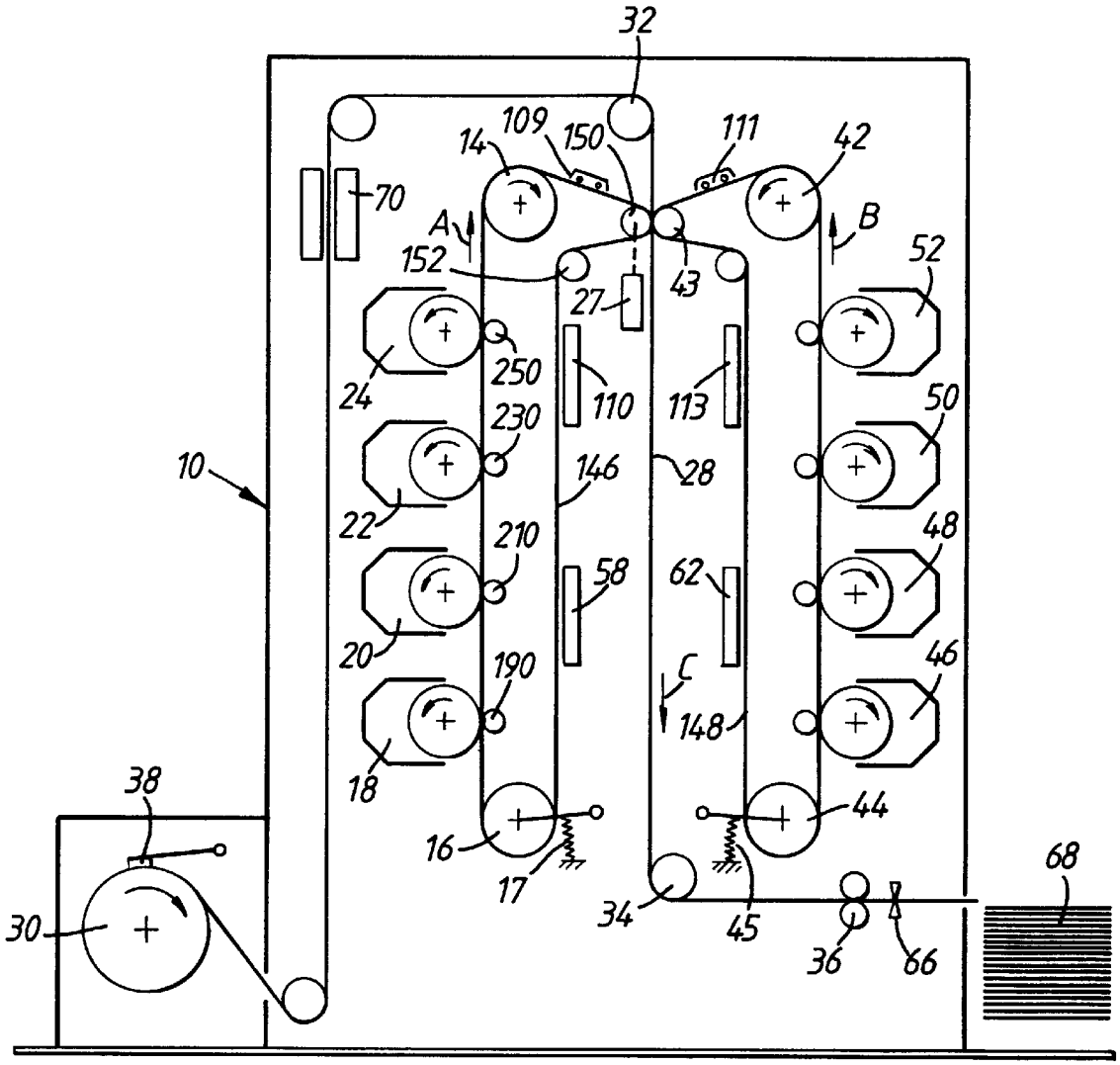
Figure 11:
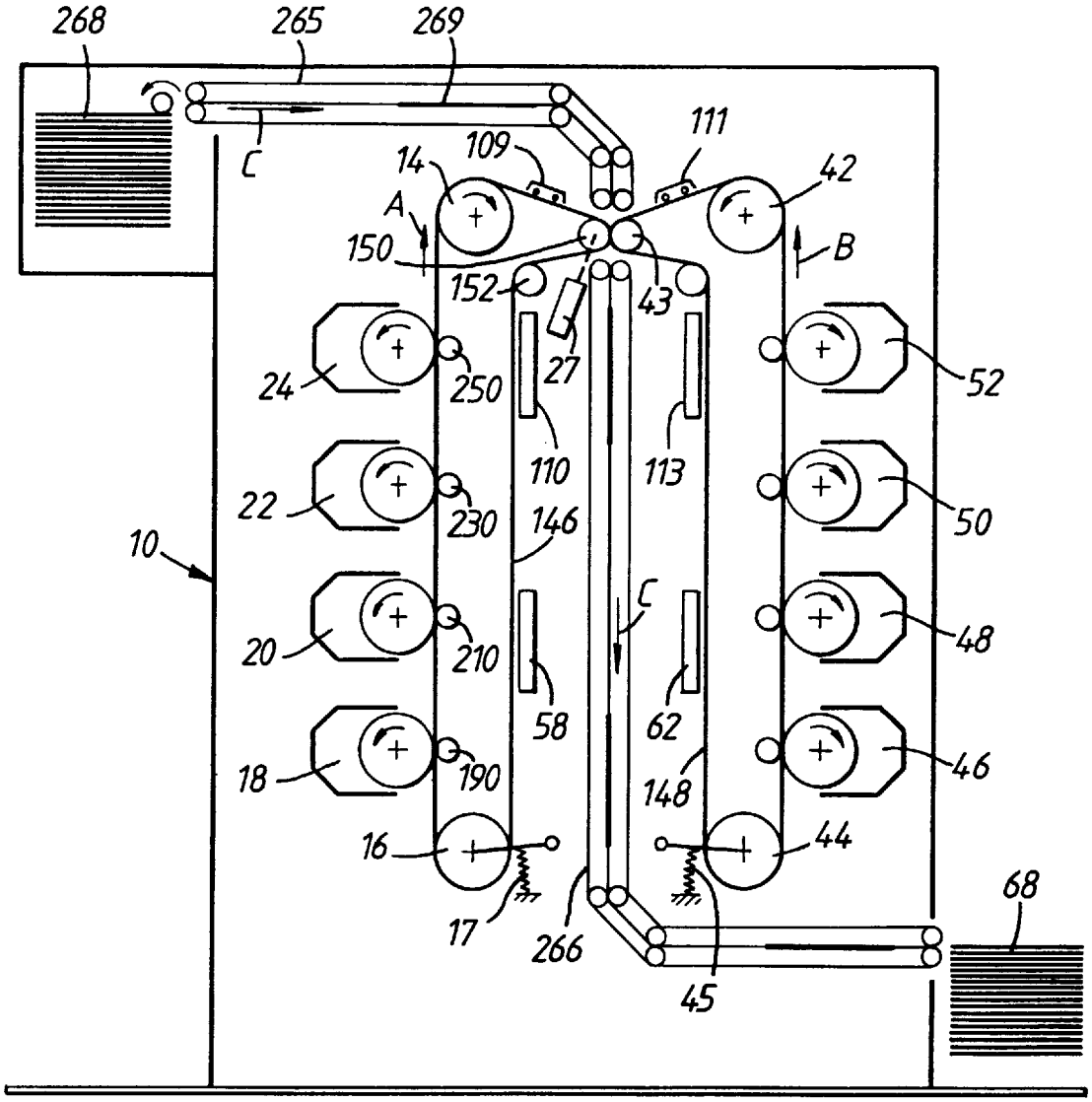
Figure 12:
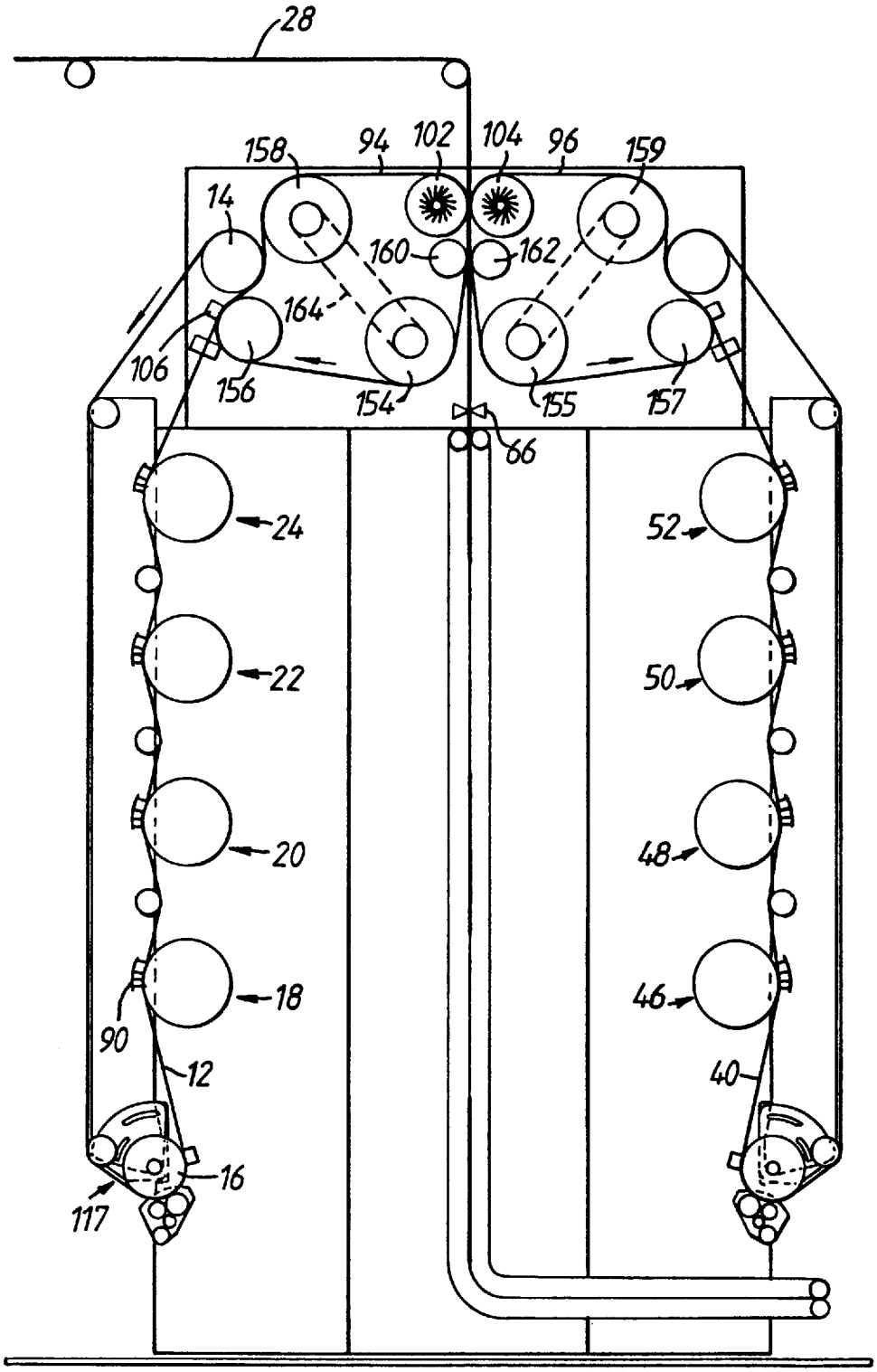
Figure 13:
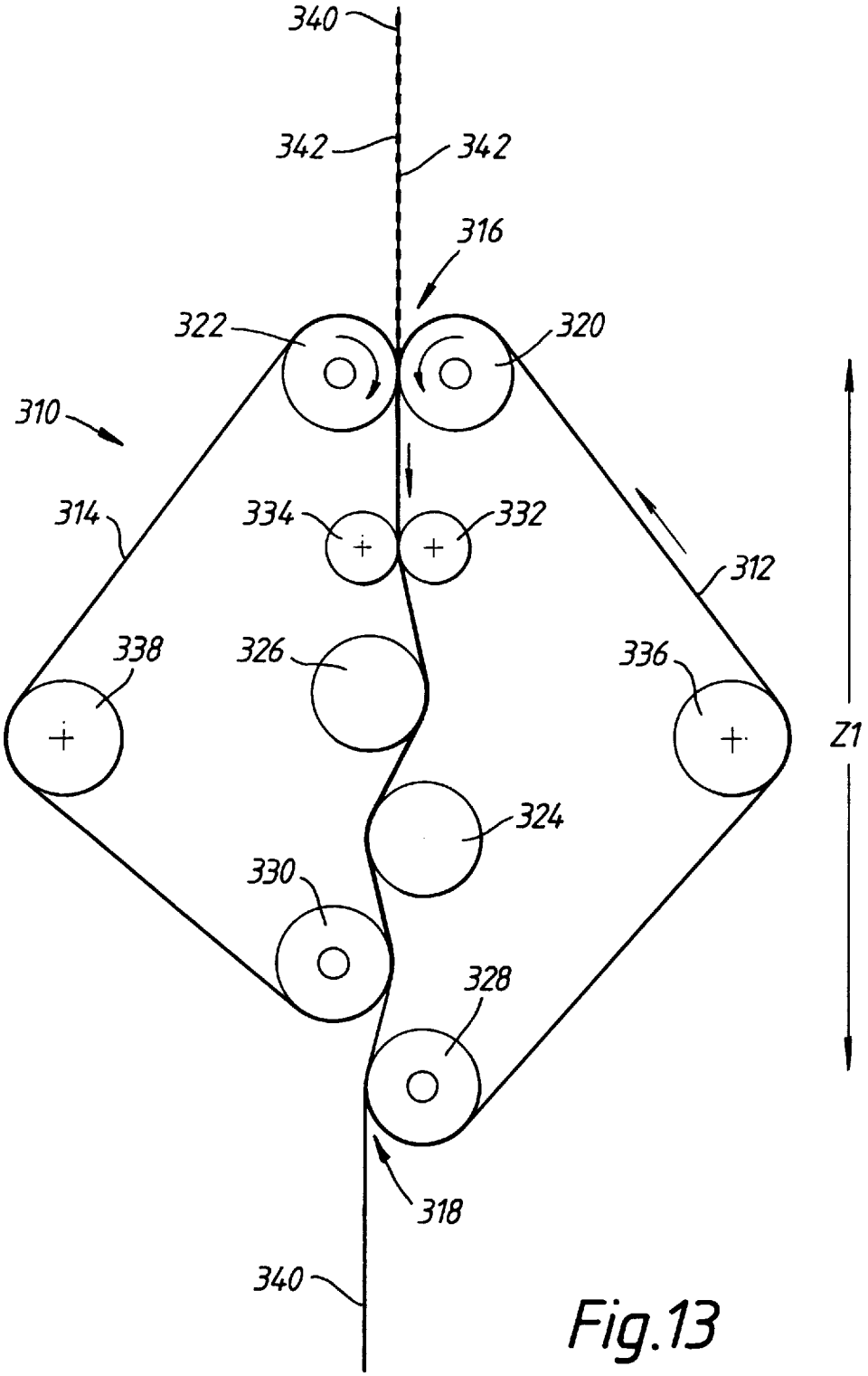
Figure 14A:
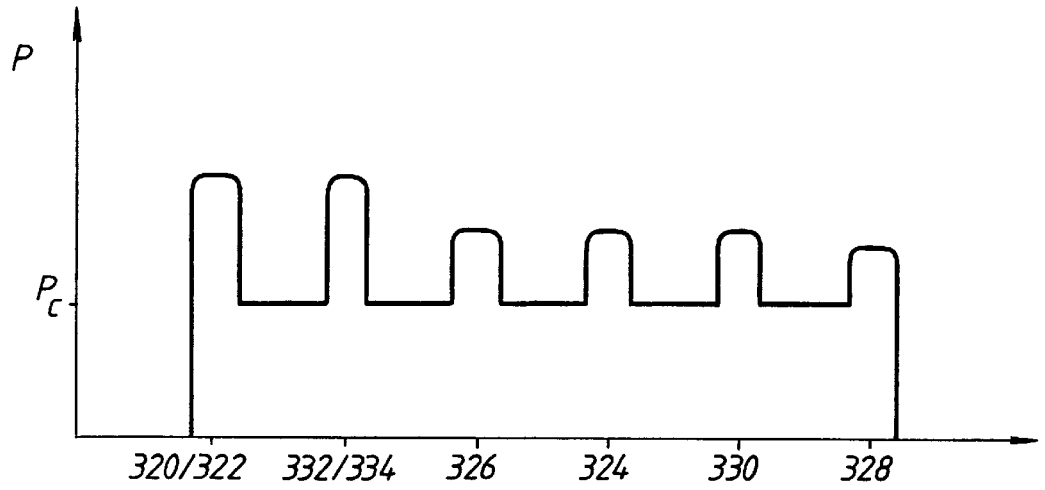
Figure 14B:
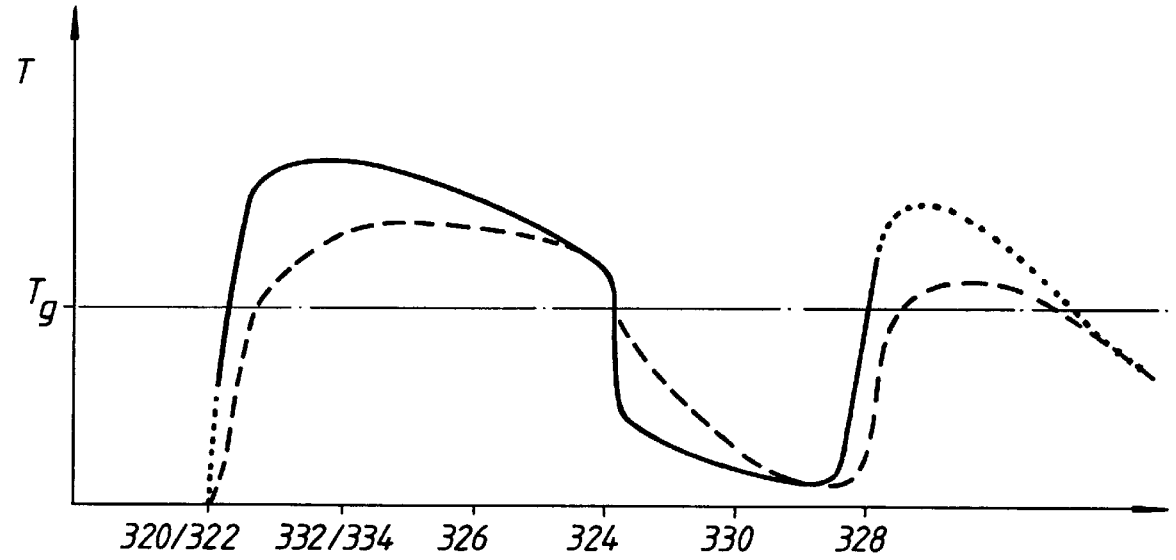
Figure 15:
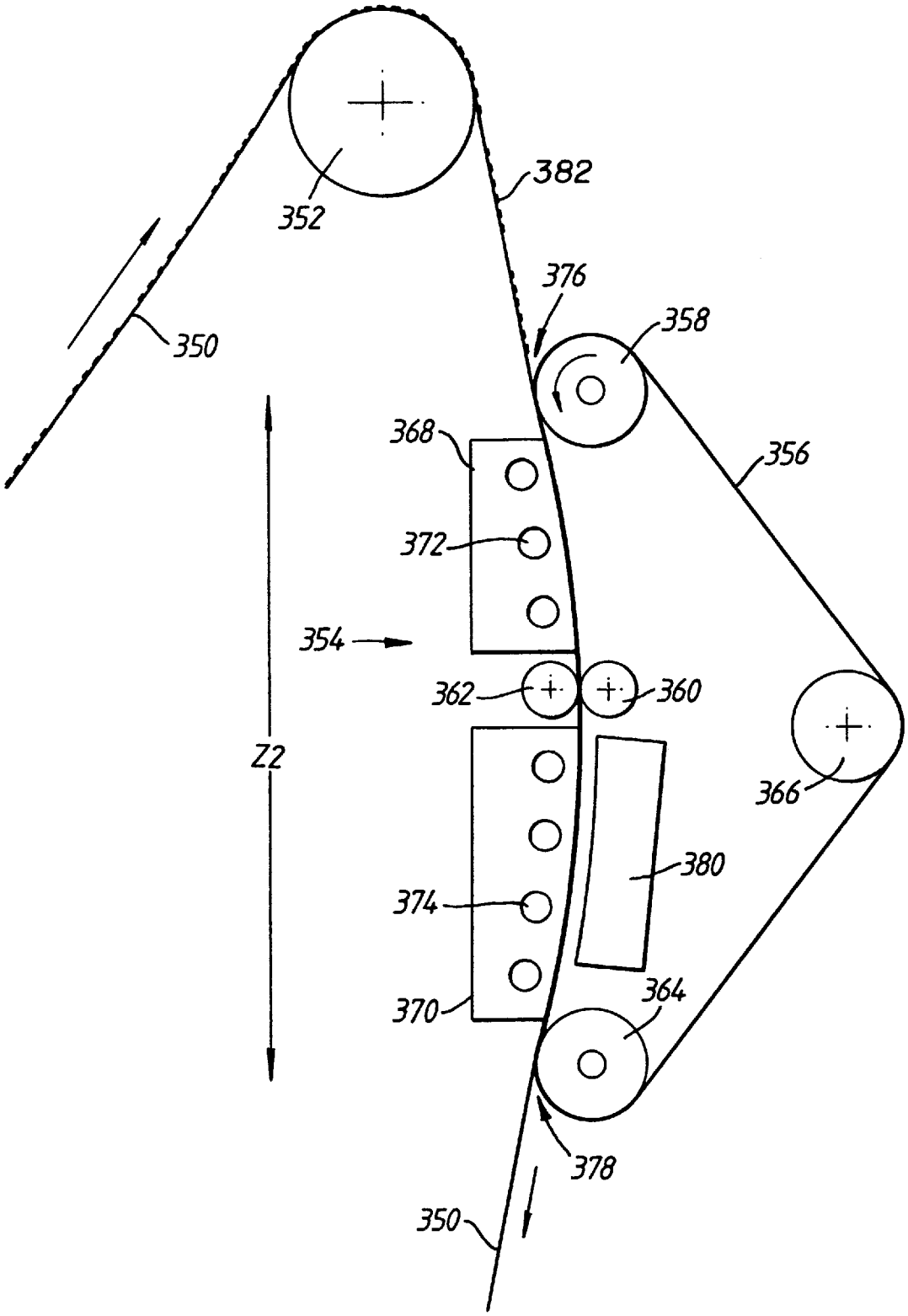
Figure 16:
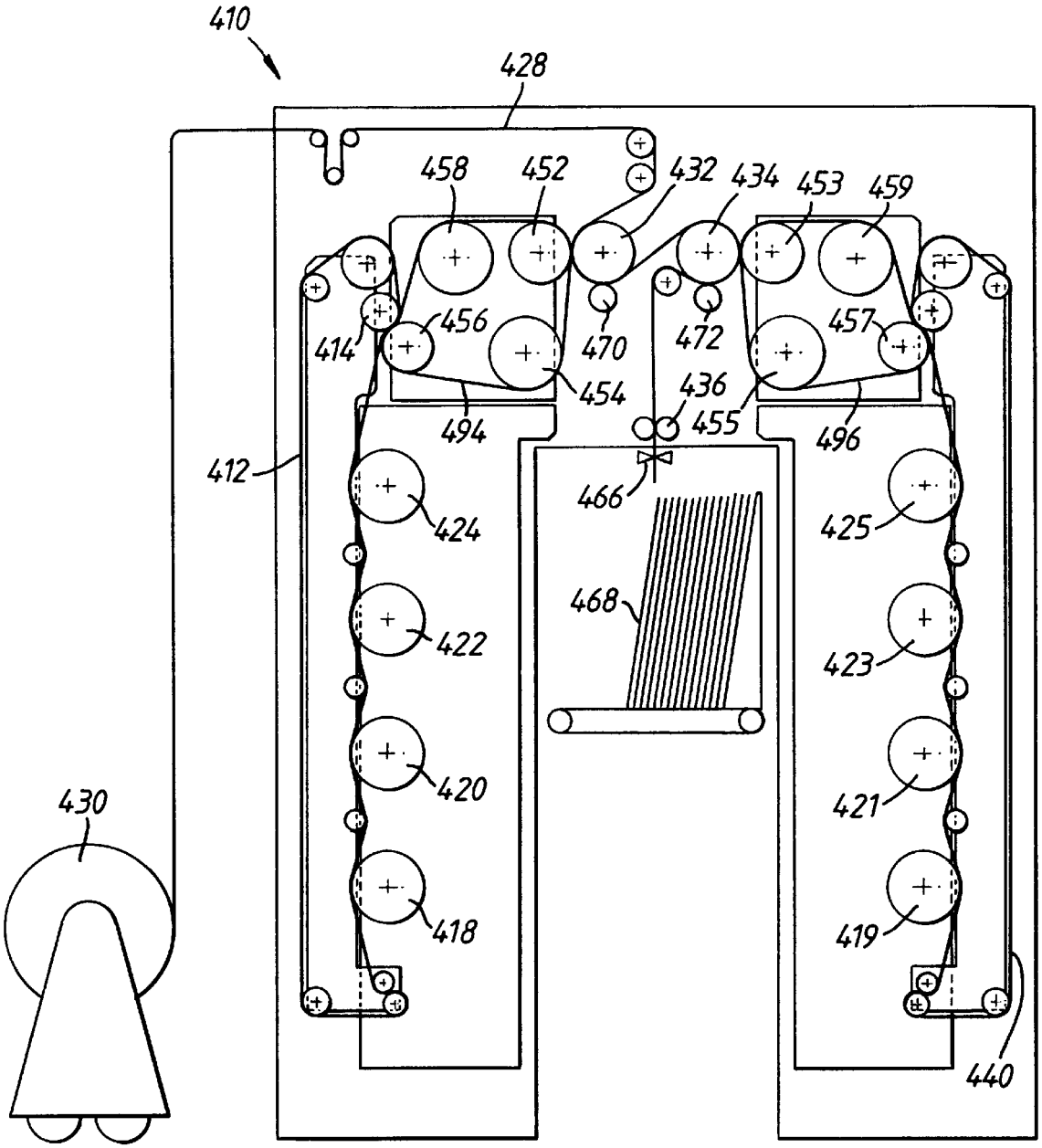
Figure 17:
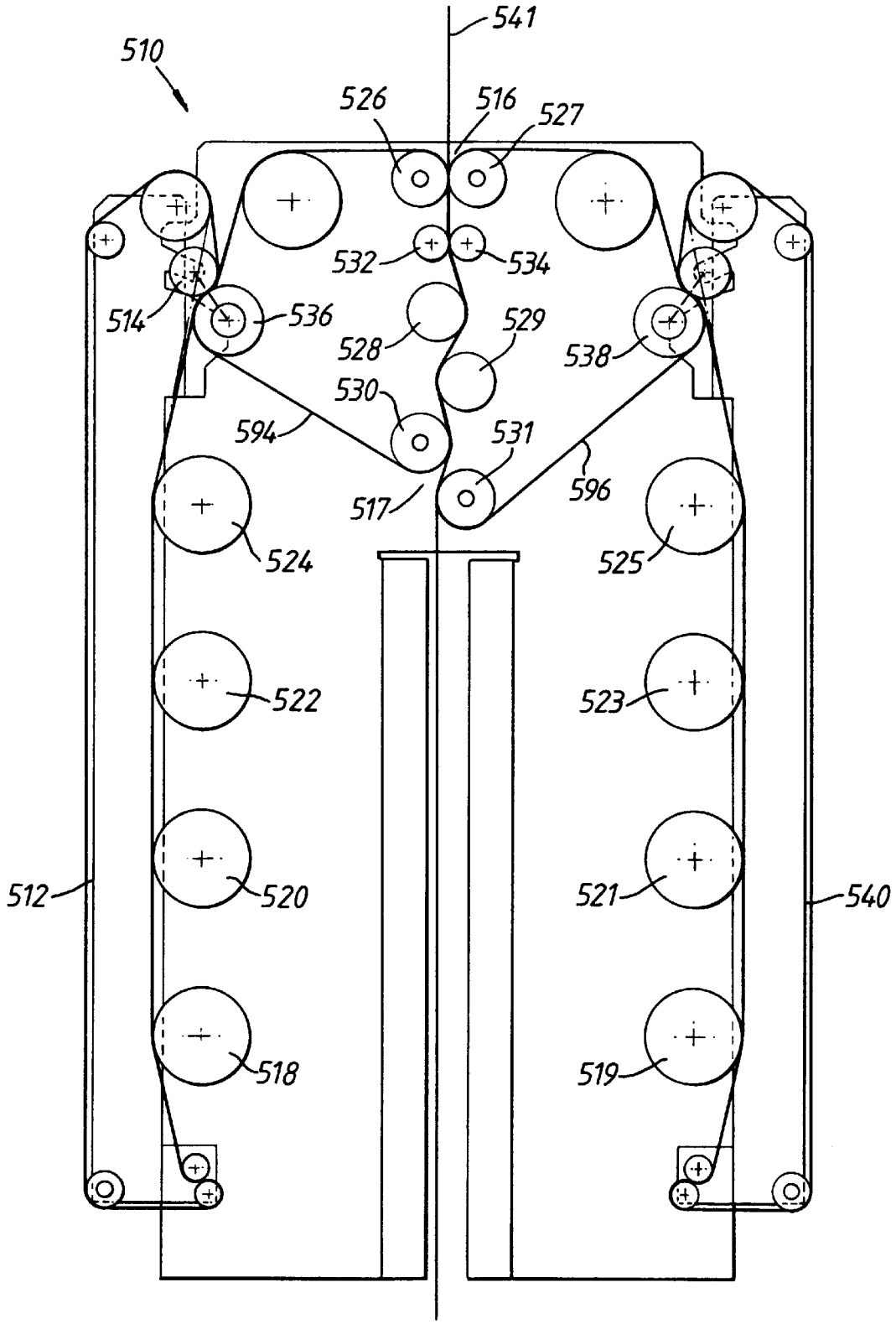

FIG. shows a modification of part of the embodiment shown in FIG. 1;

FIG. 10 illustrates an alternative embodiment of the invention in which the primary belt and the intermediate transfer member are constituted by one and the same member;

FIG. 11 illustrates a modification of the embodiment shown in FIG. 10, for cut sheet substrates instead of web substrates;

FIG. 12 illustrates a further alternative embodiment of a printer according to the invention;

FIG. 13 shows a fixing and glossing device for fixing toner images carried on both faces of a substrate in the form of a web;

FIGS. 14*a* and 14*b* charts plotting pressure and temperature against the position of the substrate in the device according to FIG. 13;

FIG. 15 shows an alternative fixing and glossing device for fixing toner images carried on one face of a substrate in the form of adhesive labels carried on a plastics material backing web;

FIG. 16 shows a single pass, multi-colour duplex electrostatographic printer according to another embodiment of the invention, incorporating a simultaneous fixing and glossing device; and FIG. 17 shows a single pass, multi-colour duplex electrostatographic printer according to another embodiment of the invention, incorporating a simultaneous fixing and glossing device similar to that shown in FIG. 13.

DETAILED DESCRIPTION OF THE INVENTION

Figure 2:
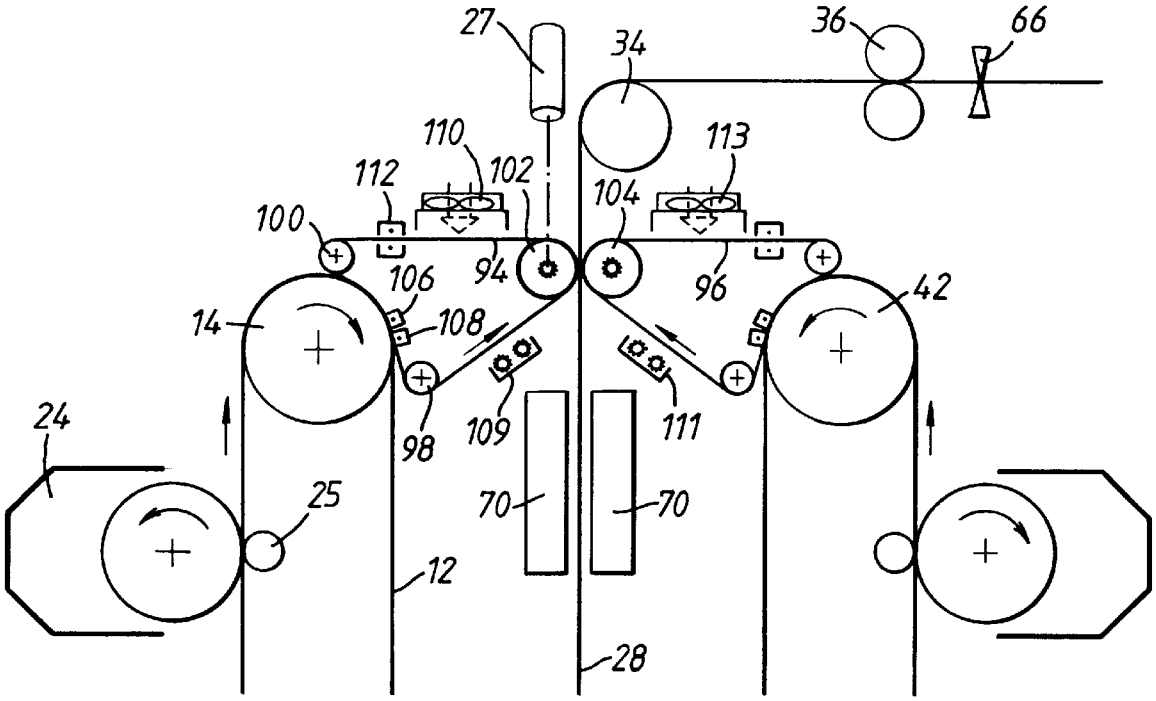
FIG. 2 is an enlarged view of part of the printer shown in FIG. 1.

FIGS. 1 and 2 show a single pass, multi-colour duplex electrostatographic printer 10. The printer comprises a first primary seamless belt 12 which passes over major guide rollers 14, 16. The primary belt 12 moves in a substantially vertical direction shown by the arrow A past a set of four toner image producing stations 18, 20, 22, 24.

At the four toner image producing stations 18, 20, 22, 24, a plurality of toner images of different colours are transferred by transfer rollers 19, 21, 23, 25 to the primary belt in register with each other to form a first multiple toner image, as described in more detail below with reference to FIG. 3, as described in European patent application EP 629927 (Xeikon NV) (corres. to U.S. Pat. No. 5,499,093). These image producing stations may be similar to each other except in respect of the colour of the toner with which they are supplied.

A spring 17 acting on the major guide roller 16 is provided for tensioning that part 13 of the primary belt 12 which extends past the toner image producing stations 18, 20, 22, 24.

An intermediate transfer member in the form of a seamless transfer belt 94, formed of an electrically insulating material such as a KAPTON (Trade Mark), is in contact with the primary belt 12 downstream of the last image producing station 24. As shown more clearly in FIG. 2, the transfer belt 94 passes over a pair of spaced guide rollers 98, 100 which are so positioned as to bring the transfer belt 94 into contact with the primary belt or toner image carrying belt 12 as it passes over the earthed upper guide roller 14. The transfer belt 94 also passes over a first heated guide roller 102. The heated guide roller 102 is driven by a master drive motor 27. Drive is therefore transmitted in turn from the drive motor 27, via the transfer belt 94 to the primary belt 12 downstream of the toner image producing stations and to the toner image producing stations themselves.

The major guide roller 14 and the intermediate transfer belt 94 are positioned relative to each other to form a nip or contact region therebetween, through which the primary belt 12 passes. Adherent contact between the primary belt and the intermediate transfer belt causes the primary belt and the intermediate transfer belt to move in synchronism with each other.

A paper web 28 is unwound from a supply roll 30 and passes into the printer. The web passes over freely rotating rollers 32 and 34 in the direction of the arrow C to a pair of web drive rollers 36, driven by a slave motor (not shown). Tension in the web 28 is controlled by application of a brake 38 applied to the supply roll 30.

The first multiple toner image adhering to the surface of the primary belt 12 is transferred to the moving intermediate transfer belt 94 by a transfer corona device 106. The moving intermediate transfer belt 94 is in face-to-face contact with the primary belt 12 over a wrapping angle determined by the position of guide rollers 98, 100. The charge sprayed by the transfer corona device 106, being on the opposite side of the intermediate transfer belt from the multiple toner image carrying belt 12, and having a polarity opposite in sign to that of the charge on the toner particles, attracts the toner particles away from the primary belt 12 and onto the surface of the intermediate transfer belt 94. The transfer corona device typically has its corona wire positioned about 7 mm from the housing which surrounds it and 7 mm from the intermediate transfer belt. A typical transfer corona current is about 3 $\mu$A/cm corona width. The transfer corona device 106 also serves to generate a strong adherent force between the intermediate transfer belt 94 and the primary belt 12, causing the latter to be rotated in synchronism with the movement of the intermediate transfer belt 94 and urging the toner particles into firm contact with the surface of the intermediate transfer belt 94. A web discharge corona device 108 driven by alternating current is provided circumferentially beyond the transfer corona device 106 and serves to eliminate sparking as the intermediate transfer belt 94 leaves the surface of the primary belt 12.

After the transfer of the multiple toner image thereto, the intermediate transfer belt 94 passes an infra-red radiant heater 109 which raises the temperature of the toner particles to about 150° C., the optimum temperature for final transfer to the paper web 28. So as to ensure that the toner particles on the intermediate transfer belt 94 are not subjected to sudden cooling as they reach the guide roller 102, the latter is heated. By the use of an elevated temperature at the point of transfer to the paper web 28, and by virtue of the higher surface energy of the paper web relative to the intermediate transfer belt 94, the transfer of toner is 100% complete, so that there may be no necessity to clean excess toner particles from the intermediate transfer belt. Nevertheless, a cleaning device, such as a cleaning roller, may be provided to remove any residual toner particles from the intermediate transfer belt, which residual particles may result during an emergency stop or paper breakdown.

After leaving the heated guide roller 102 the temperature of the intermediate transfer belt 94 is reduced by a cooling device 110 and any residual charge on the intermediate transfer belt is removed by an opposing pair of corona discharge devices 112.

The transfer belt 94 is preferably tensioned by means not shown, for example by means of a spring loaded tensioning roller. If this tensioning roller is located on the upper run of the intermediate transfer belt 94, it may suitably be in the form of a water cooled roller, in which event it assists in the cooling of the intermediate transfer belt 94 after transfer, in addition to, or in place of the cooling device 110.

The printer shown in FIGS. 1 and 2 is adapted for duplex printing. To achieve this, the printer further comprises a second primary belt 40 which passes over major guide rollers 42, 44. A spring 45 acting on the major guide roller 44 is provided for tensioning the second primary belt 40 whereby drive is transmitted from the major guide roller 42 to the second primary belt 40 to drive the primary belt in the direction shown by the arrow B past a second set of four toner image producing stations 46, 48, 50, 52, which are driven in turn by the second primary belt 40. At the four toner image producing stations 46, 48, 50, 52, a plurality of toner images of different colours are transferred to the primary belt in register with each other to form a second image.

A second intermediate transfer belt 96 is in contact with the second primary belt 40 downstream of the last image producing station 52 of the second set. After the transfer of the second multiple toner image thereto, the intermediate transfer belt 96 passes an infra-red radiant heater 111 which raises the temperature of the toner particles, as described in connection with the first multiple image.

The first heated guide roller 102 is positioned in opposition to a second heated guide roller 104, referred to in more detail below, to form a transfer nip or contact region therebetween, through which the substrate in the form of a paper web 28 passes. The intermediate transfer belts serve to feed the paper web through the printer. Thus the paper web 28 is brought into contact with the first and second intermediate transfer belts 94, 96 whereby the first multiple toner image is transferred to one face of the paper web while the second multiple toner image is transferred to the opposite face thereof.

After leaving the heated guide roller 104 the temperature of the second intermediate transfer belt 96 is reduced by a cooling device 113.

Each primary belt 12, 40 has a toner image carrying surface formed for example of polyethylene terephthalate.

After contact of the intermediate transfer belt 94, the belt 12 passes a cleaning station 58, where residual toner is removed from the primary belt and any residual electrostatic charge thereon is neutralised. Similarly, a second cleaning station 62 is provided for the second primary belt 40.

Downstream of the drive roller pair 36, the paper web passes to a cutting station 66 where the web is cut into sheets which are collected in a stack 68. The length of the images formed on the paper web may, of course, be of any length, independent of the dimensions of the components of the printer, especially the image producing stations. The web can be cut into sheets of variable length, depending on the length of the image transferred thereto.

An infra-red radiant heater pair 70 for heating the paper web 28 is provided upstream of the intermediate transfer belts 94, 96, in order to avoid a sudden change in temperature at the transfer nip.

Figure 3:
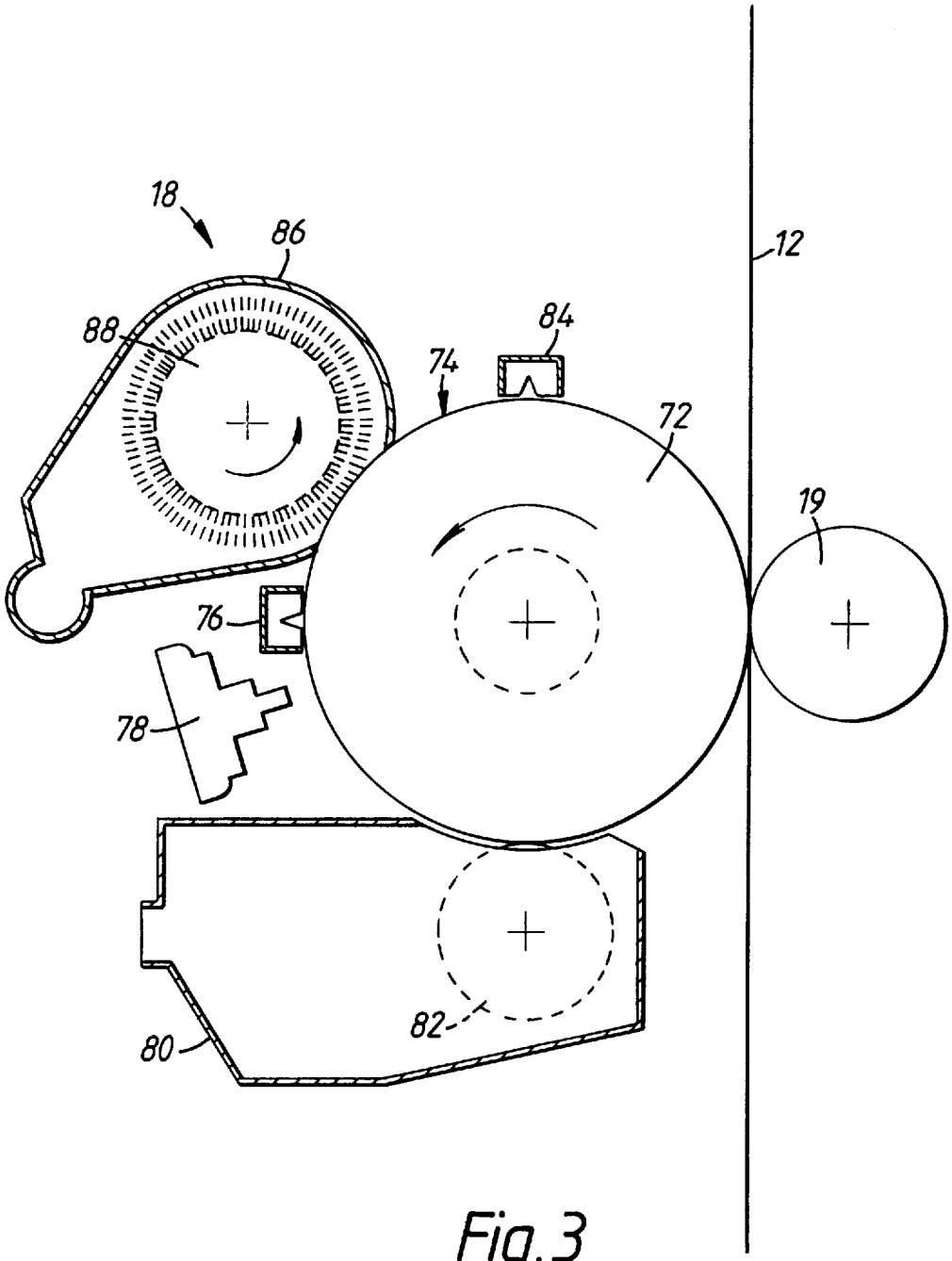
FIG. 3 shows details of one of the image-forming stations of the printer shown in FIG. 1.

As shown in FIG. 3, which shows for example the image producing station 18 of FIG. 1, each toner image producing station comprises rotatable endless surface means in the form of a cylindrical drum 72 having a photoconductive outer surface 74. Circumferentially arranged around the drum 72 there is a main corotron or scorotron charging device 76 capable of uniformly charging the drum surface 74, for example to a potential of about −600 V, an exposure station 78 which may, for example, be in the form of a scanning laser beam or an LED array, which will image-wise and line-wise expose the photoconductive drum surface 74 causing the charge on the latter to be selectively reduced, for example to a potential of about −250 V, leaving an image-wise distribution of electric charge to remain on the drum surface 74. This so-called "latent image" is rendered visible by a developing station 80 which by means known in the art will bring a developer in contact with the drum surface 74. The developing station 80 includes a developer drum 82 which is adjustably mounted, enabling it to be moved radially towards or away from the drum 72 for reasons as will be explained further below. According to one embodiment, the developer contains (a) toner particles containing a mixture of a resin, a dye or pigment of the appropriate colour and normally a charge-controlling compound giving triboelectric charge to the toner, and (b) carrier particles charging the toner particles by frictional contact therewith. The carrier particles may be made of a magnetizable material, such as iron or iron oxide. In a typical construction of a developer station, the developer drum 82 contains magnets carried within a rotating sleeve causing the mixture of toner and magnetizable material to rotate therewith, to contact the surface 74 of the drum 72 in a brush-like manner. Negatively charged toner particles, triboelectrically charged to a level of, for example −9 $\mu$c/g, are attracted to the photo-exposed areas on the drum surface 74 by the electric field between these areas and the negatively electrically biased developer roll so that the latent image becomes visible.

After development, the toner image adhering to the drum surface 74 is transferred to the moving primary belt 12 by application of the biased transfer roller 19. The moving primary belt 12 is in face-to-face substantially tangential contact with the drum surface 74 as determined by the position of the guide rollers 14 and 16 (see FIG. 1).

Thereafter, the drum surface 74 is pre-charged to a level of, for example −580 V, by a pre-charging corotron or scorotron device 84. The pre-charging makes the final charging by the corotron 76 easier. Thereby, any residual toner which might still cling to the drum surface may be more easily removed by a cleaning unit 86 known in the art. Final traces of the preceding electrostatic image are erased by the corotron 76. The cleaning unit 86 includes an adjustably mounted cleaning brush 88, the position of which can be adjusted towards or away from the drum surface 74 to ensure optimum cleaning. The cleaning brush 88 is earthed or subject to such a potential with respect to the drum as to attract the residual toner particles away from the drum surface. After cleaning, the drum surface is ready for another recording cycle.

FIGS. 4 to 8 show various modifications of the printer shown in FIGS. 1 to 3. In these Figures, like features are indicated with like reference numerals.

Figure 4:
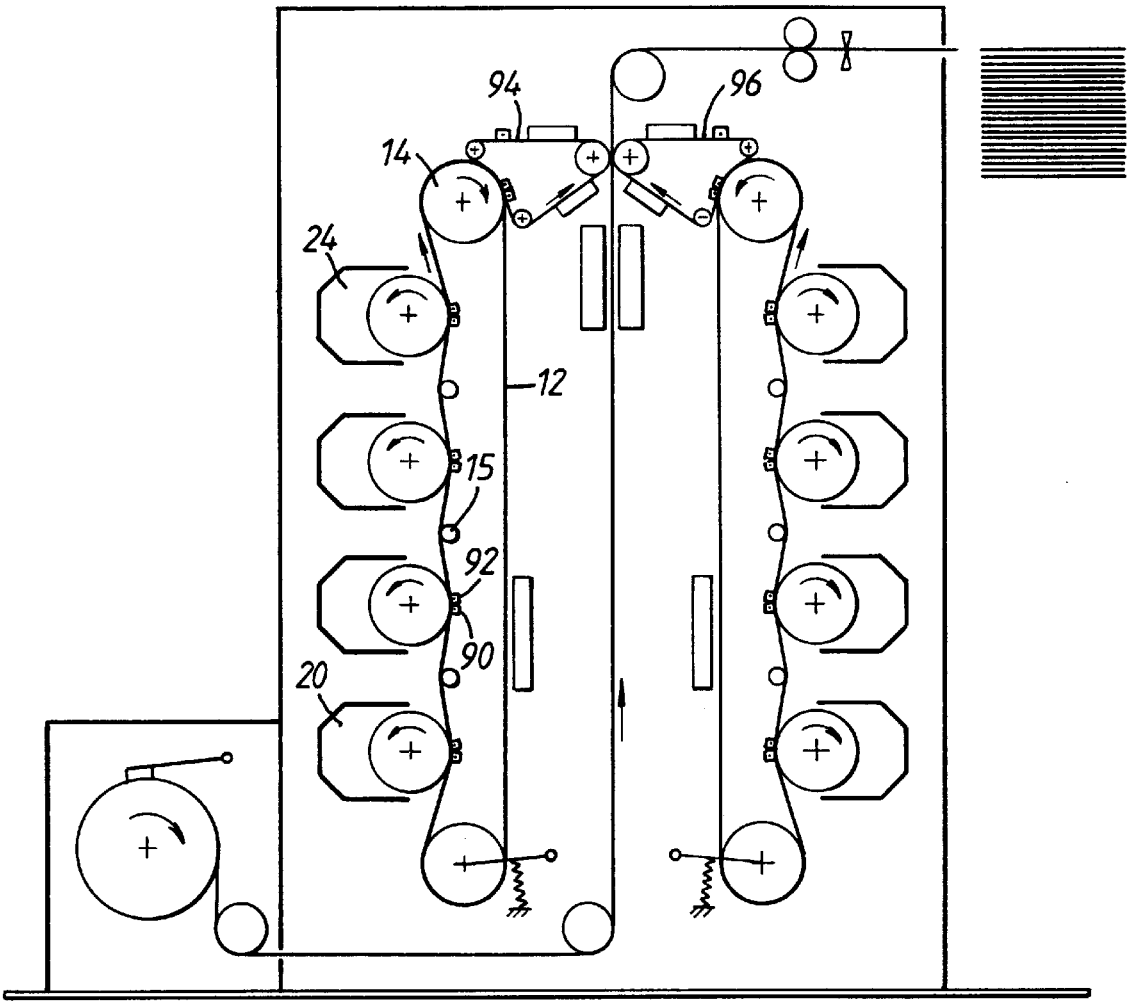
FIG. 4 shows a modification of the duplex printer shown in FIG. 1.

The embodiment shown in FIG. 4 is similar to that shown in FIG. 1 except that the biased rollers 19 etc. of the embodiment shown in FIG. 1 are each replaced by a pair of corona devices, namely a transfer corona device 90 and a primary belt discharge corona device 92 and the primary belt 12 is guided between the image producing stations over intermediate guide rollers 15.

Figure 5:
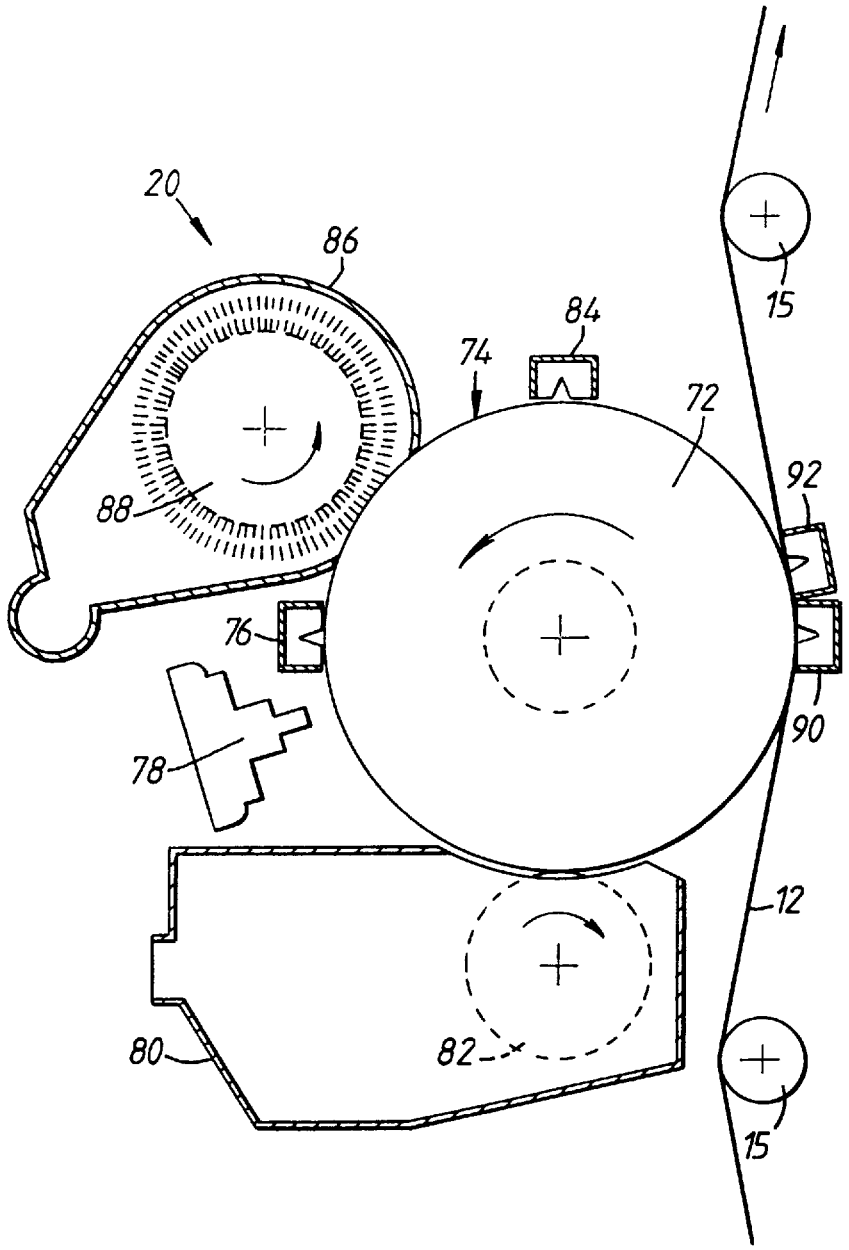
FIG. 5 shows details of one of the image-forming stations of the printer shown in FIG. 4.

As shown in FIG. 5, which shows for example the image producing station 20 of FIG. 4, after development, the toner image adhering to the drum surface 74 is transferred to the moving primary belt 12 by a transfer corona device 90. The moving primary belt 12 is in face-to-face contact with the drum surface 74 over a small wrapping angle determined by the position of guide rollers 15. The charge sprayed by the transfer corona device 90, being on the opposite side of the primary belt to the drum, and having a polarity opposite in sign to that of the charge on the toner particles, attracts the toner particles away from the drum surface 74 and onto the surface of the primary belt 12. The transfer corona device typically has its corona wire positioned about 7 mm from the housing which surrounds it and 7 mm from the primary belt. A typical transfer corona current is about 3 $\mu$A/cm primary belt width. The transfer corona device 90 also serves to generate a strong adherent force between the primary belt 12 and the drum surface 74, causing the latter to be rotated in synchronism with the movement of the primary belt 12 and urging the toner particles into firm contact with the surface of the primary belt 12. The primary belt, however, should not tend to wrap around the drum beyond the point dictated by the positioning of a guide roller 15 and there is therefore provided circumferentially beyond the transfer corona device 90 a primary belt discharge corona device 92 driven by alternating current and serving to discharge the primary belt 12 and thereby allow the primary belt to become released from the drum surface 74. The primary belt discharge corona device 92 also serves to eliminate sparking as the primary belt leaves the surface 74 of the drum.

The moving primary belt 12 is in face-to-face contact with the drum surface 74 as determined by the position of the guide rollers 14 and 16 and the intermediate guide rollers 15.

Figure 6:
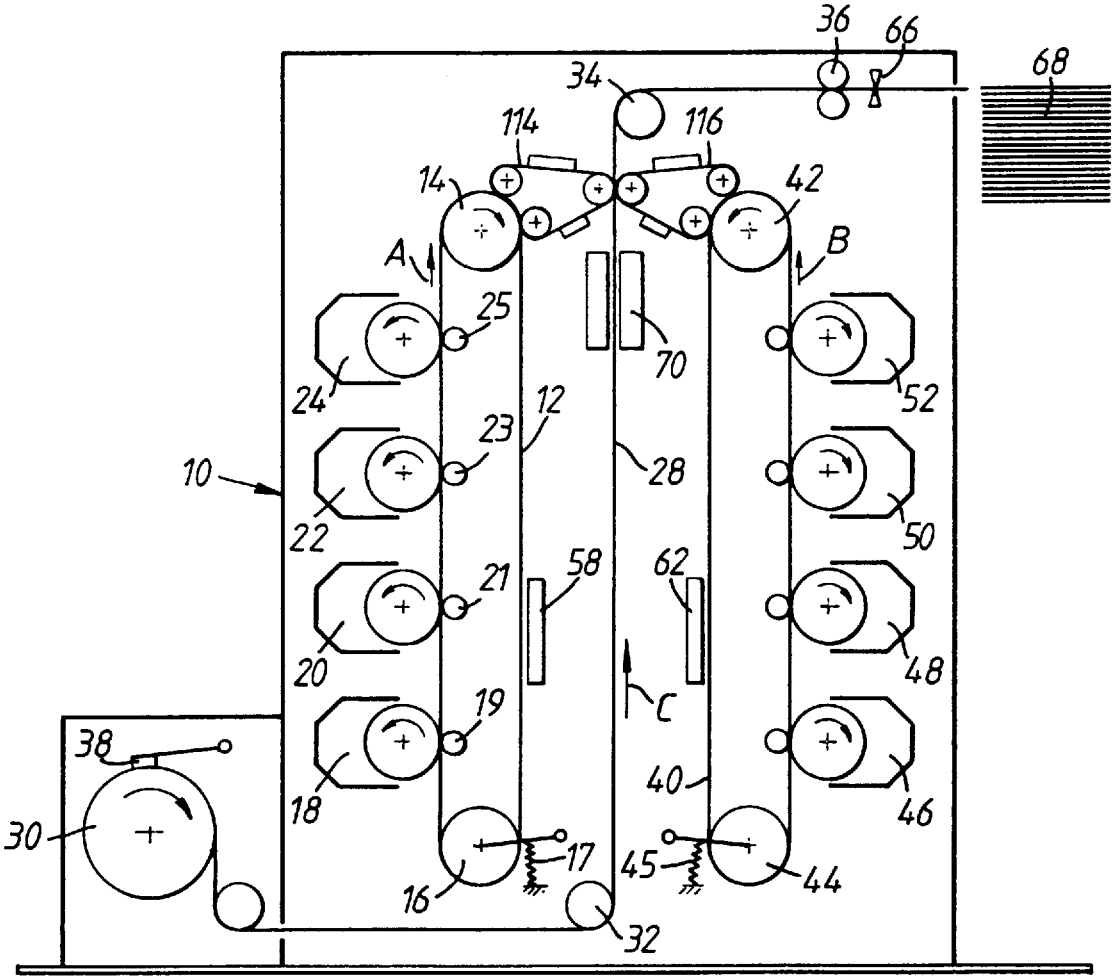
FIG. 6 shows another modification of the duplex printer shown in FIG. 1.
Figure 7:
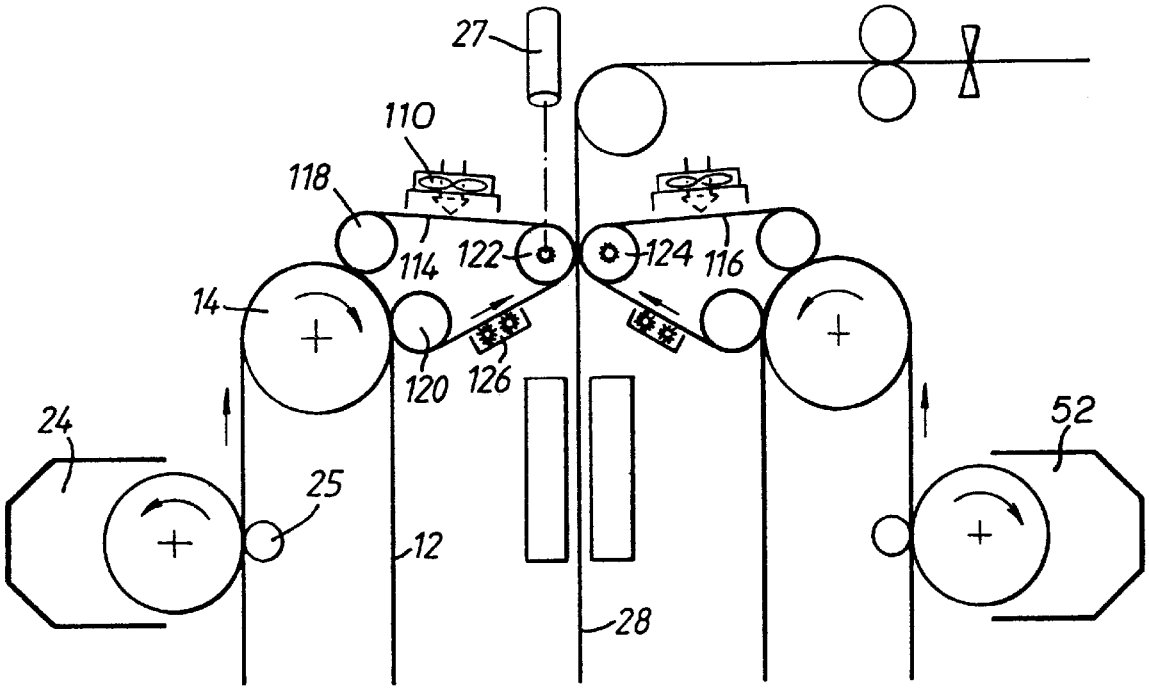
FIG. 7 is an enlarged view of part of the printer shown in FIG. 6.

In the embodiment shown in FIGS. 6 and 7, the first and second heat intermediate transfer belts 94, 96 of the embodiment of FIG. 1 are replaced respectively by first and second intermediate transfer belts 114, 116 formed for example of a metal (steel) backing coated with a silicone rubber. As shown more clearly in FIG. 7, the first intermediate transfer belt 114 passes over a pair of spaced guide rollers 118, 120 which are urged by spring pressure towards the earthed guide roller 14 and are so positioned as to bring the first intermediate transfer belt 114 into contact with the primary belt 12 as the intermediate transfer belt 114 passes over the upper guide roller 14. The first intermediate transfer belt 114 also passes over a first heated guide roller 122 which is positioned adjacent a second heated guide roller 124 to form a nip or contact region therebetween, through which the paper web 28 passes. The pair of spaced guide rollers 118, 120 may be replaced by a single guide roller if desired.

The multiple toner image adhering to the surface of the primary belt 12 is transferred to the moving intermediate transfer belt 114 by pressure. The transfer of the multiple toner image from the primary belt 12 to the intermediate transfer belt 114 is improved by applying a voltage of appropriate polarity by means not shown to the metal backing of the intermediate transfer belt 114. The moving intermediate transfer belt 114 is in face-to-face contact with the primary belt 12 over a wrapping angle determined by the position of guide rollers 118, 120. The spring pressure applied to the guide rollers 118, 120 towards the guide roller 14 serves to generate a strong adherent force between the intermediate transfer belt 114 and the primary belt 12, causing the latter to be rotated in synchronism with the movement of the intermediate transfer belt 114 and urging the toner particles into firm contact with the surface of the intermediate transfer belt 114.

After the transfer of the multiple toner image thereto, the intermediate transfer belt 114 passes an infra-red radiant heater 126 which raises the temperature of the toner particles to about 150° C.

The embodiment shown in FIGS. 6 and 7 has the advantage over the embodiment shown in FIG. 1 that by avoiding the use of corona discharge devices less ozone is generated in use and it is possible to use metal backed belts which are usually stronger than belts formed of other materials.

Figure 8:
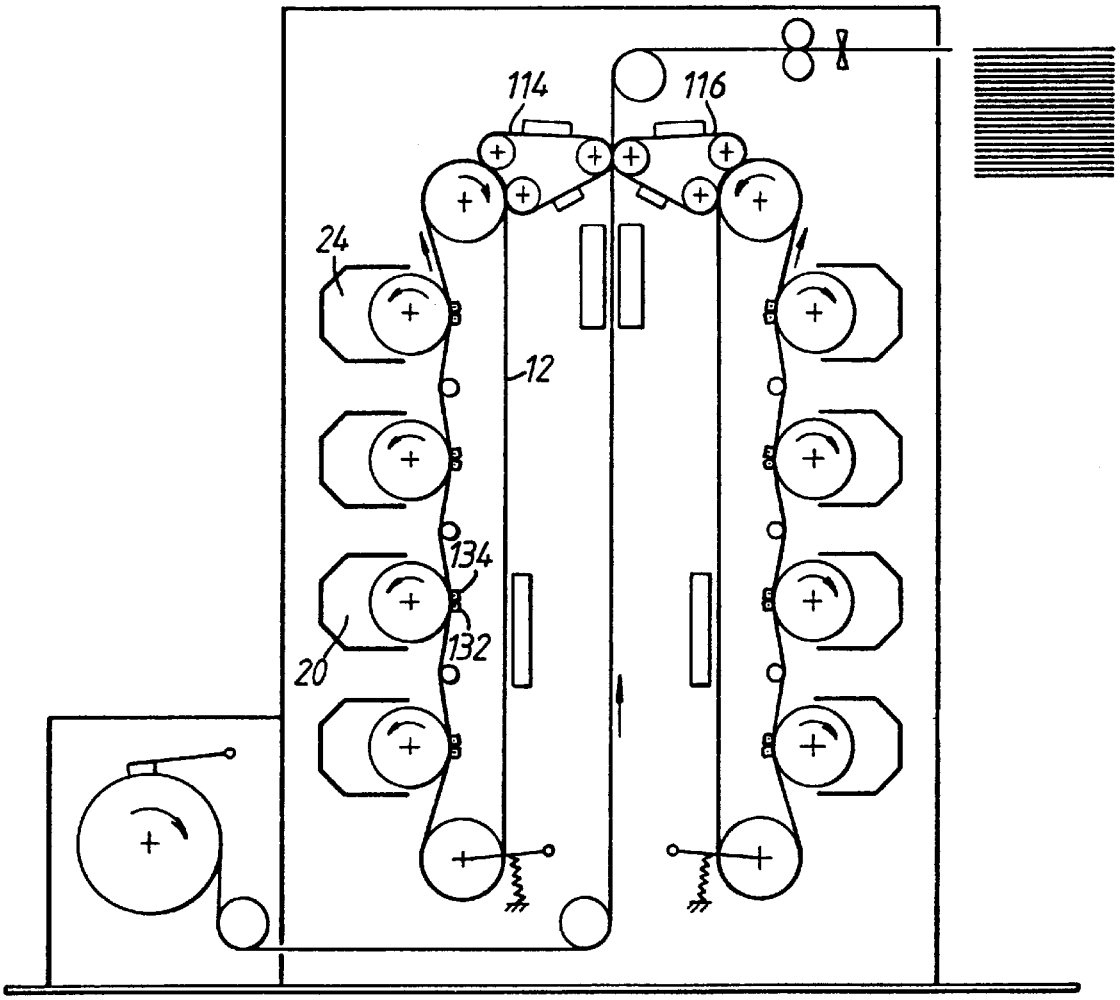
FIG. 8 shows a modification of the duplex printer shown in FIG. 6.

The embodiment shown in FIG. 8, is similar to that shown in FIG. 6 and 7 except that the biased rollers 19 etc. of the embodiment shown in FIG. 6 are each replaced by a pair of corona devices, namely a transfer corona device 132 and a web discharge corona device 134, which operate as described in connection with FIGS. 4 and 5 and the primary belt 12 is guided between the image producing stations over intermediate guide rollers.

Figure 9:
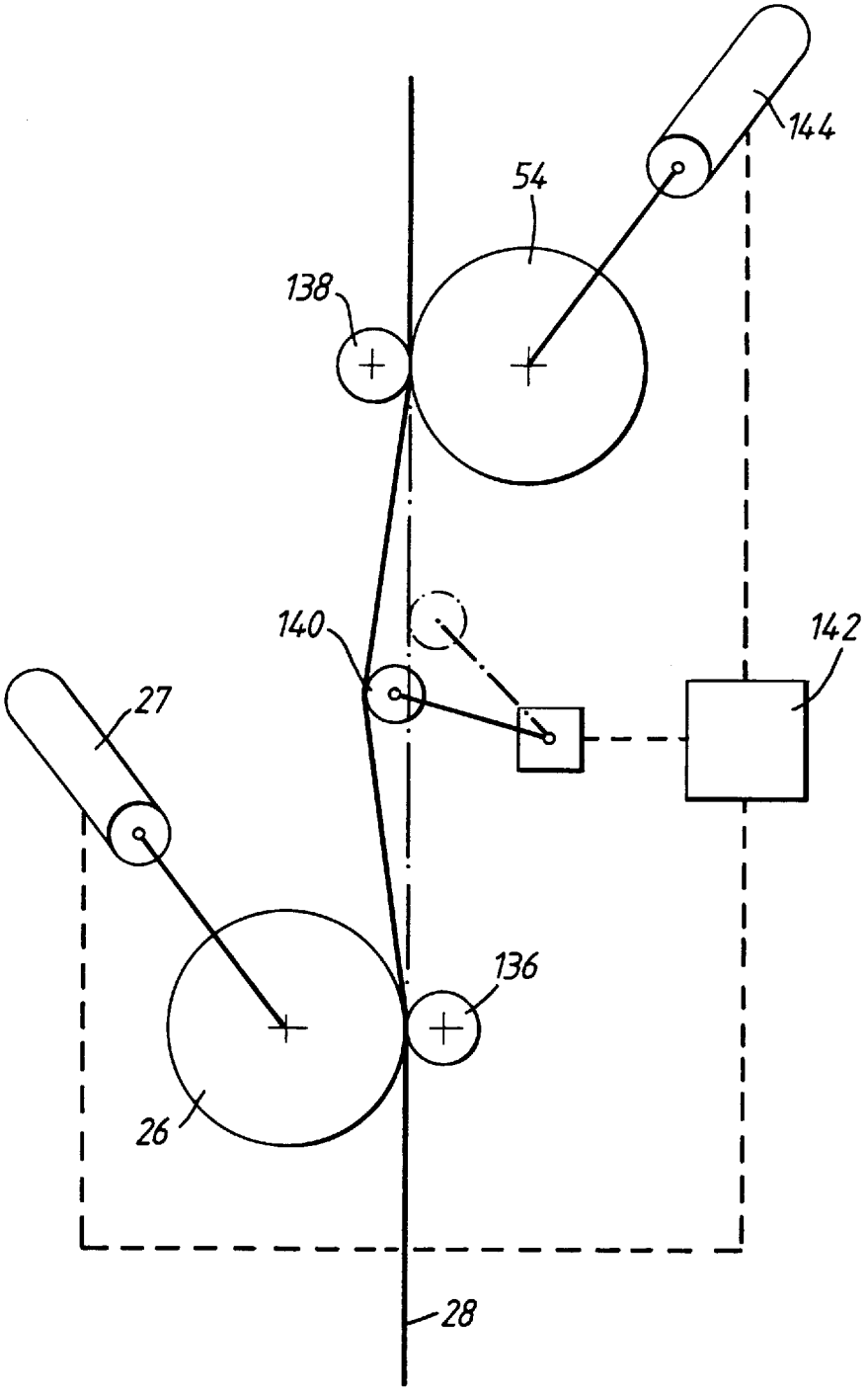

FIG. 9 shows a modification of the embodiment shown in FIG. 1, which modification can be utilised with suitable adaptation to any of the embodiments shown in FIGS. 1 to 8.

In the alternative embodiment shown in FIG. 9, the first and second intermediate transfer belts (not shown) pass over first and second guide rollers 26, 54, respectively, which are spaced from each other, each being provided with a respective counter roller 136, 138 to define a nip or contact region through which the paper web 28 passes. Between the first and second guide rollers 26, 54 the paper web 28 is in contact with position sensing device 140, the output of which is connected to a control device 142 which, in a known manner, serves to control the master drive motor 27 and the slave drive motor 144 for driving the respective intermediate transfer belts to ensure that the intermediate transfer belts run at the same speed. The advantage of this embodiment is that the counter rollers 136, 138 can be chosen as ideal to form a nip which is independent of the flexibility of the intermediate transfer belts.

FIG. 10 shows an alternative embodiment of the invention in which the primary belt 12 and the intermediate transfer member 94 of FIG. 1 are constituted by one and the same member. Thus, FIG. 10 shows a single pass, multi-colour duplex electrostatographic printer 10. The printer comprises a first seamless transfer belt 146 which passes over major guide rollers 14, 16. The transfer belt 146 moves in the direction shown by the arrow A past a set of four toner image producing stations 18, 20, 22, 24. At the four toner image producing stations 18, 20, 22, 24, a plurality of toner images of different colours are transferred by biased transfer rollers 190, 210, 230, 250 to the transfer belt 146 in register with each other to form a first multiple toner image, as described in more detail above with reference to FIG. 3. A spring 17 acting on the major guide roller 16 is provided for tensioning that part of the transfer belt 146 which extends past the toner image producing stations 18, 20, 22, 24. The transfer belt 146 is, for example, formed of an electrically insulating material such as a KAPTON (Trade Mark) or, alternatively, a metal belt having a toner image carrying surface formed of a silicone elastomer. In the latter case, it is advantageous to apply a voltage of, say, 1.0 kV to the rear metal surface of the belt to improve the efficiency of transfer of toner images thereto. The transfer belt 146 also passes over two guide rollers, namely a first heated guide roller 150 and a non-heated, optionally cooled, guide roller 152. The first heated guide roller 150 is positioned in opposition to a second heated guide roller 43 to form a transfer nip or contact region therebetween, through which substrate in the form of a paper web 28 passes. The heated guide roller 150 is driven by a drive motor 27. Drive is therefore transmitted in turn from the drive motor 27, via the transfer belt 146 to the toner image producing stations.

In advance of the transfer nip, the transfer belt 146 passes an infra-red radiant heater 109 which raises the temperature of the toner particles to about 150° C., the optimum temperature for final transfer to the paper web 28. So as to ensure that the toner particles on the intermediate transfer belt 146 are not subjected to sudden cooling as they reach the guide roller 150, the latter is heated. By the use of an elevated temperature at the point of transfer to the paper web 28, and by virtue of the higher surface energy of the paper web relative to the intermediate transfer belt 146, the transfer of toner is 100% complete, so that there may be no necessity to clean excess toner particles from the intermediate transfer belt. Nevertheless, a cleaning device 58, such as a cleaning roller, may be provided to remove any residual toner particles from the transfer belt 146, which residual particles may result during start-up or run-down of the printer.

After leaving the heated guide roller 150 the temperature of the transfer belt 146 is reduced by a cooling device 110. This cooling device may, for example, be in the form of a bank of cold air spraying nozzles, directed at the adjacent surface of the transfer belt 146. In an alternative arrangement, the transfer belt 146 may pass through a chamber of significant size, containing cooled or even ambient air, where the temperature of the transfer belt 146 is allowed to fall. Such a chamber may include means for defining a festoon-like path for the transfer belt.

The printer shown in FIG. 10 is adapted for duplex printing. To achieve this, the printer further comprises a second transfer belt 148 which passes over major guide rollers 42, 44. A spring 45 acting on the major guide roller 44 is provided for tensioning the second transfer belt 148 whereby drive is transmitted from the guide roller 43 to the transfer belt 148 to drive the transfer belt 148 in the direction shown by the arrow B past a second set of four toner image producing stations 46, 48, 50, 52. At the four toner image producing stations 46, 48, 50, 52, a plurality of toner images of different colours are transferred to the transfer belt 148 in register with each other to form a second image.

After the transfer of the second multiple toner image thereto, the transfer belt 148 passes an infra-red radiant heater 111 which raises the temperature of the toner particles, as described in connection with the first multiple image.

The first and second transfer belts 146, 148 are positioned in opposition to each other to form a transfer nip or contact region therebetween, through which the paper web passes. The transfer belts serve to feed the paper web through the printer. Thus the paper web 28 is brought into contact with the first and second transfer belts 146, 148 whereby the first multiple toner image is transferred to one face of the paper web while the second multiple toner image is transferred to the opposite face thereof. The cooling devices 110, 113 cool the transfer belts 146, 148 respectively, after the transfer of the toner images to the paper web 28.

Downstream of the transfer nip, the belt 146 passes the cleaning station 58 where residual toner is removed from the transfer belt and any residual electrostatic charge thereon is neutralised. Similarly, a second cleaning station 62 is provided for the second transfer belt 148.

As in the embodiment shown in FIG. 1, downstream of the drive roller pair 36, the paper web passes to a cutting station 66 where the web is cut into sheets which are collected in a stack 68. The web can be cut into sheets of 40 variable length, depending on the length of the image transferred thereto. An infra-red radiant heater pair 70 for heating the paper web 28 is provided in advance of the transfer nip.

FIG. 11 shows an alternative embodiment whereby, instead of the substrate being in the form of a web, cut sheet feed is used. From a supply stack 268, sheets 269 are fed by means of a transport belt 265 towards the transfer nip in the direction of the arrow C. After transfer, the sheets 269 are further transported by means of a transport belt 266 towards the output stack 68.

The embodiment shown in FIG. 12 is similar to that shown in FIGS. 1 and 2. That is, FIG. 12 shows a single pass, multi-colour duplex electrostatographic printer which comprises a first primary seamless belt 12 which passes over major guide rollers 14, 16. The primary belt 12 moves past a set of four toner image producing stations 18, 20, 22, 24. At the four toner image producing stations 18, 20, 22, 24, a plurality of toner images of different colours are transferred by corona transfer devices 90 to the primary belt in register with each other to form a first multiple toner image.

A tensioning device 117 acts on the major guide roller 16 for tensioning the primary belt 12.

An intermediate transfer member in the form of a seamless transfer belt 94, is in contact with the primary belt 12 downstream of the last image producing station 24. In this embodiment, the intermediate transfer belt is in the form of a metal band of 70 $\mu$m thickness carrying a 25 $\mu$m thickness silicone coating. The transfer belt 94 passes over a pair of spaced guide rollers 156, 158 which are so positioned as to bring the transfer belt 94 into contact with the primary belt or toner image carrying belt 12 as it passes over the upper guide roller 14. The guide roller 156 also acts as a cooling roller, being formed with a hollow interior through which cooling fluid, such as water, at a controlled temperature close to room temperature passes. The guide roller 158 also acts as a first stage heating roller, or pre-heating roller, being formed as a hollow roller through the hollow interior of which a heat transfer fluid such as water at an elevated temperature is passed. The transfer belt 94 also passes over guide rollers 102, 160 and 154. Drive is transmitted in turn from a drive motor (not shown) to the guide roller 102, via the transfer belt 94 to the primary belt 12 downstream of the toner image producing stations and to the toner image producing stations themselves.

The major guide roller 14 and the intermediate transfer belt 94 are positioned in opposition to each other to form a contact region therebetween, through which the primary belt 12 passes. Adherent contact between the primary belt and the intermediate transfer belt causes the primary belt and the intermediate transfer belt to move in synchronism with each other.

The multiple toner image adhering to the surface of the primary belt 12 is transferred to the moving intermediate transfer belt 94 by a transfer corona device 106.

The first stage heating roller 158 raises the temperature of the toner particles to about 90° C. The second stage heating roller 102 is heated to about 160° C., for example by use of an internal radiant heater.

After leaving the heated guide roller 102 the transfer belt 94 passes to a guide roller 160, the region between the guide rollers 102 and 160 constituting a contact region. After leaving the transfer region, the temperature of the intermediate transfer belt 94 is reduced by a first-stage cooling roller, or pre-cooling roller 154, which is in the form of a hollow roller through the hollow interior of which a cooling fluid such as water is passed. A heat transfer circuit 164 is provided, whereby heat extracted by the cooling fluid from the transfer belt 94 at the first stage cooling roller 154 is transferred to the first stage heating roller 158 to raise the temperature of the multi-colour toner image on the transfer belt before transfer to the substrate. This arrangement reduces the energy requirement. The heat transfer fluid may be subjected to additional heating as, or before, it enters the hollow interior of the first stage heating roller 158 and/or may be subjected to further cooling as, or before it enters the hollow interior of the first stage cooling roller 154.

In a typical embodiment, the first-stage heating roller 158 raises the temperature of the multi-colour toner image on the transfer belt 94 to about 90° C., the second-stage heating roller 102 raises the temperature further to about 160° C., the optimum temperature for final transfer to the paper web 28. Following transfer of the image to the substrate, the first-stage cooling roller 154 reduces the temperature of the transfer belt 94 to about 90° C., while the cooling roller 156 reduces the temperature of the transfer member to about 20° C., ideal for electrostatic transfer of a further image in powder form onto the transfer belt 94.

The printer shown in FIG. 12 is adapted for duplex printing. To achieve this, the printer further comprises a second primary belt 40 which moves past a second set of four toner image producing stations 46, 48, 50, 52. At the four toner image producing stations 46, 48, 50, 52, a plurality of toner images of different colours are transferred to the primary belt in register with each other to form a second image.

A second intermediate transfer belt 96 is in contact with the second primary belt 40 downstream of the last image producing station 52 of the second set. The second intermediate transfer belt is guided over first- and second-stage cooling rollers 155, 157, a first-stage heating roller 159, the second-stage heating roller 104 and the guide roller 162.

The first heated guide roller 102, and the guide roller 160 are positioned in opposition to the second heated guide roller 104 and the guide roller 162, to form an extended transfer nip or contact region therebetween, through which the substrate in the form of a paper web passes. The intermediate transfer belts serve to feed the paper web 28 through the printer. Thus the paper web is brought into contact with the first and second intermediate transfer belts 94, 96 whereby the first multiple toner image is transferred to one face of the paper web while the second multiple toner image is transferred to the opposite face thereof. A cutting station 66 may be provided to cut the printed paper web 28 into sheets.

After leaving the contact region, the temperature of the second intermediate transfer belt 96 is reduced by first-and second-stage cooling rollers 155 and 157.

FIGS. 13 to 15 illustrate the principle of a device for simultaneously fixing a toner image on a substrate and providing the image with the desired gloss, as applied to a substrate already carrying an unfixed toner image.

Referring to FIG. 13, the device 310 comprises a first transfer belt 312, and a second transfer belt 314 which constitutes a reaction surface in face-to-face pressure contact with the first transfer belt to form an extended contact zone Z1 therebetween, thereby to define a substrate path extending through the contact zone from an entrance 316 to an exit 318. Each transfer belt is impermeable, comprising a 70 $\mu$m metal backing carrying a 30 μm coating of non-abhesive silicone material such as DOW 200 Series (ex Dow Corning Corporation).

The first transfer belt 312 passes over, and is in contact with, a hard metal heated roller 320 which directly heats the first transfer belt adjacent the entrance 316 to a temperature above the softening point (i.e. the glass transition temperature) $T_g$ of the toner. It is advisable for this heated roller to be as large as possible (the figure is not to scale in this respect) in order to more efficiently heat the associated transfer belt to its required temperature. Similarly, the second transfer belt 314 passes over a heated roller 322 which directly heats the second transfer belt 314 adjacent the entrance 316 to a temperature above the glass transition temperature $T_g$ of the toner.

Each transfer belt 312, 314 also passes over, and is in contact with, a respective resilient cooling roller 324, 326 which directly cools the respective transfer belt intermediate the entrance and the exit of the contact zone Z1 to a temperature below the glass transition temperature $T_g$ of the toner. The cooling rollers 324, 326 are so positioned as to ensure more than tangential contact between each cooling roller 324, 326 and its associated transfer belt. Thus each transfer belt 312, 314 partially wraps around its associated cooling roller 324, 326 to increase the forcible cooling effect achieved thereby to a temperature below the glass transition temperature $T_g$ of the toner.

Each transfer belt 312, 314 also passes over a respective second heated roller 328, 330 which heats the transfer belt adjacent the exit 318 of the contact zone Z1 to a temperature at least 10° C. above the glass transition temperature $T_g$ of the toner.

A pair of intermediate pressure rollers 332, 334 are located one on either side of the extended contact zone Z1, upstream of the cooling rollers 324, 326.

Each transfer belt 312, 314 also passes over a respective tensioning and alignment roller 336, 338, the position of which is adjustable, by operation of means not shown, well known to those skilled in the art, to ensure adequate tension in the transfer belts and to ensure their correct alignment. The unit is driven by the paper web. A drive connected to the second heated roller 328 is driven in torque to compensate for mechanical looses.

The device shown in FIG. 13 operates as follows. A substrate in the form of a paper web 340, leaves an electrostatographic printing or copying machine (not shown) carrying unfixed multi-colour toner particle images 342 on both faces. The substrate is fed along the substrate path between the first and second transfer belts 312, 314 from the entrance 316 to the wit 318 of the extended contact zone. The substrate is fed at a speed such as to spend from 5 to 10 seconds in the contact zone. The transfer belts 312, 314 are heated by the heating rollers 320, 322 adjacent the entrance 316 to 160° C., which is above the glass transition temperature $T_g$ of the toner. The transfer belts 312, 314 are forcibly cooled by the cooling rollers 324, 326 intermediate the entrance and the exit to 50° C., which is below the glass transition temperature $T_g$ of the toner. The toner images 342 on the substrate thereby become fixed to the substrate, and their appearance is rendered glossy, with high colour saturation.

In FIGS. 14*a* and 14*b*, there are shown charts plotting pressure and temperature against the position of the substrate in the device according to FIG. 13. Both plots indicate position along their horizontal axes, by using the reference numbers used in FIG. 13.

Referring to FIG. 14*a*, it will be seen that the pressure P to which the substrate is subjected rises as the substrate enters the contact zone, with the heated roller 320 at the entrance thereof. Pressure then falls back to an intermediate value $P_C$ which represents the contact pressure between the first and second transfer belts. Pressure peaks again as the substrate passes between the intermediate pressure rollers 332, 334, with small peaks occurring as the substrate passes the cooling rollers 326 and 324 and the second heated rollers 330 and 328. Thereafter the pressure falls to zero as the substrate leaves the contact zone.

Referring to FIG. 14*b* the temperature T of the transfer belt 312 is indicated by a continuous line. The temperature of the toner on that face of the substrate which is towards the rollers 320, 332, 324 and 328 is indicated by a dotted line. The temperature of the body of the substrate itself is indicated by a broken line.

While the substrate is in the contact zone, the temperature of the toner closely follows that of the transfer belt, since it has such a relatively small thermal capacity. It will be seen that the temperature of the toner rises sharply as the substrate enters the contact zone at the entrance of which the first heating rollers 320, 322 are located, the temperature of the toner exceeding the softening temperature $T_g$ thereof. The toner particles are now soft enough to be pressed into the body of the substrate and to be flattened by application of the pressure between the transfer belts leading to the desired fixing and glossing effects. At this high temperature, moisture is driven out of the substrate, but is unable to escape due to the impermeable nature of the transfer belts. The temperature of the body of the substrate rises less rapidly, the toner being located on the surface of the substrate, but gradually heat is transferred from the toner and the transfer belts to the body of the substrate as the substrate progresses through the contact zone. An equilibrium position, where the temperature of the toner and the body of the substrate are identical, may be reached as unforced cooling of both slowly occurs. As the substrate reaches the cooling roller 324, the temperature of the toner, following the temperature of the transfer belt, drops rapidly to a level below $T_g$, with the temperature of the body of the substrate somewhat lagging behind. This hardens the toner in its fixed and flattened state. This cooling causes the moisture which had been driven out of the substrate to be condensed on the surfaces of the transfer belts, now at a lower temperature than the substrate body. At the exit to the contact zone, where the second heated rollers 330, 328 are located, the temperature of the toner, still following the temperature of the transfer belt, again increases to a level above $T_g$, with the temperature of the body of the substrate lagging behind. The temperature difference between the toner and the body of the substrate is important at this point. If the temperature of the body of the substrate were to be above $T_g$ as the substrate separates from the transfer belt 312, there would be a risk of the bond between the toner particles and the substrate breaking, resulting in the deposition of toner on the transfer belt, i.e. resulting in offset. As it is, the weakest bond is between the toner particles and the transfer belt and it is therefore here that the break occurs, thereby avoiding problems of offset. Furthermore, this second heating drives the moisture which had been condensed on the surfaces of the transfer belts back into the substrate, so that overall substantially no moisture is lost from the substrate.

The present invention provides a number of advantages compared with known devices:

(i) the consumption of toner powder may be reduced;

(ii) the moisture content of the substrate is retained;

(iii) where the substrate is a transparent material, such as an over head projector sheet, the contrast of the image is improved;

(iv) gloss can be deeper than can be achieved with known devices, because the first roller can be very hot;

(v) there are no additional consumables; and (vi) better coverage of the substrate by the toner particles leads to the possibility of a greater range of hues obtainable from combinations of toners of different colours, since the colour of the substrate itself plays a less important role to the spectral character of the image.

In the alternative embodiment of FIG. 15, the web 350 of a substrate in the form of adhesive labels carried on a plastics material backing web passes over a guide roller 352 before entering the fixing device 354. In this fixing device a single transfer belt 356 passes over a heated roller 358, between a pair of intermediate pressure rollers 360, 362, over a second heated roller 364 and a tensioning and alignment roller 366. The transfer belt 356 is impermeable, comprising a 70 $\mu$m metal backing carrying a 30 $\mu$m coating of non-abhesive silicone material such as DOW 200 Series (ex Dow Corning Corporation). In this embodiment, the reaction surface is constituted by the surfaces of two stationary bodies 368, 370, which include passages 372, 374 therethrough for the passage of cooling fluids. The contact of the transfer belt 356 with the stationary bodies 368, 370 defines a contact zone Z2, having an entrance 376 and an exit 378. Downstream of the intermediate pressure rollers 360, 362, there is provided a cooling box 380 which directs cold air against the transfer belt 356 intermediate the entrance and the exit of the contact zone Z2 to cool the transfer belt 356 to a temperature below the glass transition temperature $T_g$ of the toner.

The device shown in FIG. 15 operates as follows. The substrate leaves an electrostatographic printing or copying machine (not shown) carrying an unfixed multi-colour toner particle image 382 on the outer face of the labels. The substrate is fed along the substrate path from the entrance 376 to the exit 378 of the extended contact zone Z2. The stationary bodies 368, 370 are cooled to 90° C. and 50° C. respectively, while the transfer belt 356 is heated by the heating roller 358 adjacent the entrance 376 to 160° C., which is above the glass transition temperature $T_g$ of the toner. The transfer belt 356 is cooled by the cooling box 380 intermediate the entrance and the exit to 50° C., which is below the glass transition temperature $T_g$ of the toner. The second heated roller 364 is heated to 70° C. The toner images 382 on the substrate thereby become fixed to the substrate, and their appearance is rendered glossy, with high colour saturation, while no offset on the second heated roller 364 is found. The plastics material backing of the substrate 350 is cooled by passing over the cooling stationary bodies 368, 370, to reduce the possibility of distortion occurring therein.

The configuration of the transfer members exemplified in FIGS. 1 to 12 may be modified in such a manner as to make use of the principle of simultaneous fixing and glossing which has been illustrated in FIGS. 13 to 15. Thus, FIG. 16 shows a single pass, multi-colour duplex electrostatographic printer 410. The printer comprises a first primary seamless belt 412 passing over guide rollers, including a guide roller 414. The primary belt 412 moves in a substantially vertical direction past a set of four toner image producing stations 418, 420, 422, 424. At the four toner image producing stations 418, 420, 422, 424, a plurality of toner images of different colours are transferred by transfer coronas (not shown) to the primary belt 412 in register with each other to form a first multiple toner image, as previously described.

An intermediate transfer member in the form of an earthed seamless transfer belt 494, is in contact with the primary belt 412 downstream of the last image producing station 424. In this embodiment, the intermediate transfer belt is in the form of a metal band of 70 $\mu$m thickness carrying a 25 $\mu$m thickness silicone rubber coating. The transfer belt 494 passes over spaced guide rollers 452, 454, 456 and 458 which are so positioned as to bring the transfer belt 494 into contact with the primary belt or toner image carrying belt 412 as it passes over its upper guide roller 414.

The guide roller 458 acts as a first stage heating roller, being formed as a hollow roller through the hollow interior of which a heat transfer fluid such as water at an elevated temperature is passed. The guide roller 452 acts as a second stage heating roller, being formed for example with an internal radiant heater. The guide rollers 454 and 456 act as first and second stage cooling rollers, being formed with a hollow interior through which cooling fluid, such as water, at a controlled temperature close to room temperature passes. Drive is transmitted in turn from a drive motor (not shown) to the guide roller 452, via the transfer belt 494 to the primary belt 412 downstream of the toner image producing stations and to the toner image producing stations themselves.

The guide roller 414 and the intermediate transfer belt 494 are positioned in opposition to each other to form a contact region therebetween, through which the primary belt 412 passes. Adherent contact between the primary belt and the intermediate transfer belt causes the primary belt and the intermediate transfer belt to move in synchronism with each other.

The multiple toner image adhering to the surface of the primary belt 412 is transferred to the moving intermediate transfer belt 494 by a second function of guide roller 414 acting as an electrostatic transfer roller connected, for example, to −1000 V.

In a typical embodiment, the first-stage heating roller 458 raises the temperature of the multi-colour toner image on the transfer belt 494 to about 90° C., the second-stage heating roller 452 raises the temperature further to about 160° C., the optimum temperature for final transfer to the paper web 428. Following transfer of the image to the substrate 428 the first-stage cooling roller 454 reduces the temperature of the transfer belt 494 to about 90° C., while the cooling roller 456 reduces the temperature of the transfer member to about 20° C., ideal for electrostatic transfer of a further image onto the transfer belt 494.

The printer shown in FIG. 16 is adapted for duplex printing. To achieve this, the printer further comprises a second primary belt 440 which moves past a second set of four toner image producing stations 419, 421, 423, 425 . At the four toner image producing stations 419, 421, 423, 425, a plurality of toner images of different colours are transferred to the primary belt in register with each other to form a second image.

A second intermediate transfer belt 496 is in contact with the second primary belt 440 downstream of the last image producing station 425 of the second set. The second intermediate transfer belt is guided over first and second stage cooling rollers 455, 457, a first-stage heating roller 459, and the second-stage heating roller 453.

The intermediate transfer belts serve to feed the paper web 428 through the printer. Thus the paper web is brought into contact with the first and second intermediate transfer belts 494, 496 whereby the first multiple toner image is transferred to one face of the paper web while the second multiple toner image is transferred to the opposite face thereof.

The paper web 428 is unwound from a supply roll 430 and passes into the printer. The web passes over freely rotating counter rollers 432 and 434 to a pair of web drive rollers 436, driven by a slave motor (not shown). Tension in the web 428 is controlled by application of a brake (not shown) applied to the supply roll 430. Downstream of the drive roller pair 436, the paper web passes to a cutting station 466 where the web is cut into sheets which are collected in a stack 468. The counter rollers 432 and 434 are respectively opposed to the second stage heating rollers 452 and 453 to form first and second transfer nips therebetween. Glossing rollers 470 and 472 are located each opposed to an associated one of the counter rollers 432 and 434 to form a glossing nip through which the paper web 428 passes.

FIG. 17 shows a single pass, multi-colour duplex electrostatographic printer 510. The printer comprises a first primary seamless belt 512 passing over guide rollers, including a guide roller 514. The primary belt 512 moves in a substantially vertical direction past a set of four toner image producing stations 518, 520, 522, 524. At the four toner image producing stations 518, 520, 522, 524, a plurality of toner images of different colours are transferred by transfer coronas (not shown) to the primary belt 512 in register with each other to form a first multiple toner image.

An intermediate transfer member in the form of a seamless transfer belt 594, is in contact with the primary belt 512 downstream of the last image producing station 524. The transfer belt 594 passes over spaced guide rollers which are so positioned as to bring the transfer belt 594 into contact with the primary belt or toner image carrying belt 512 as it passes over its upper guide roller 514.

The printer shown in FIG. 17 is adapted for duplex printing. To achieve this, the printer further comprises a second primary belt 540 which moves past a second set of four toner image producing stations 519, 521, 523, 525 . At the four toner image producing stations 519, 521, 523, 525, a plurality of toner images of different colours are transferred to the primary belt in register with each other to form a second image. A second intermediate transfer belt 596 is in contact with the second primary belt 540 downstream of the last image producing station 525 of the second set.

The first and second transfer belts 594 and 596 constitute reaction surfaces in face-to-face pressure contact with each other to form an extended contact zone therebetween, thereby to define a substrate path extending through the contact zone from an entrance 516 to an exit 517. Each transfer belt is impermeable, comprising a 70 $\mu$m metal backing carrying a 30 $\mu$m coating of non-abhesive silicone material such as DOW 200 Series (ex Dow Corning Corporation).

The first transfer belt 594 passes over, and is in contact with, a hard metal heated roller 526 which directly heats the first transfer belt adjacent the entrance 516 to a temperature above the softening point (i.e. the glass transition temperature) $T_g$ of the toner. Similarly, the second transfer belt 596 passes over a heated roller 527 which directly heats the second transfer belt 596 adjacent the entrance 516 to a temperature above the glass transition temperature $T_g$ of the toner.

Each transfer belt 594, 596 also passes over, and is in contact with, a respective resilient cooling roller 528, 529 which directly cools the respective transfer belt intermediate the entrance and the exit of the contact zone to a temperature below the glass transition temperature $T_g$ of the toner. The cooling rollers 528, 529 are so positioned as to ensure more than tangential contact between each cooling roller 528, 529 and its associated transfer belt. Thus each transfer belt 594, 596 partially wraps around its associated cooling roller 528, 529 to increase the forcible cooling effect achieved thereby to a temperature below the glass transition temperature $T_g$ of the toner.

Each transfer belt 594, 596 also passes over a respective second heated roller 530, 531 which heats the transfer belt adjacent the exit 517 of the contact zone to a temperature at least 10° C. above the glass transition temperature $T_g$ of the toner.

A pair of intermediate pressure rollers 532, 534 are located one on either side of the extended contact zone, upstream of the cooling rollers 528, 529.

The device shown in FIG. 17 operates as follows. A substrate in the form of a paper web 541 is fed along the substrate path between the first and second transfer belts 594, 596 from the entrance 516 to the exit 517 of the extended contact zone. The substrate is fed at a speed such as to spend from 2 to 10 seconds in the contact zone. The transfer belts 594, 596 are heated by the heating rollers 526, 527 adjacent the entrance 516 to 160° C., which is above the glass transition temperature $T_g$ of the toner. The transfer belts 594, 596 are forcibly cooled by the cooling rollers 528, 529 intermediate the entrance and the exit to 50° C., which is below the glass transition temperature $T_g$ of the toner. The toner images on the transfer belts 594, 596 are transferred to the substrate and become fixed to the substrate, and their appearance is rendered glossy, with high colour saturation.

We claim:

1. A single pass, multi-colour electrostatographic printer comprising:

a transfer member;

drive means for moving said transfer member along a continuous path;

electrostatic deposition means for depositing a plurality of toner images of different colours in powder form in register with each other on said transfer member to form a charged multiple toner image thereon;

substrate feed means to feed a substrate along a substrate path into contact with said transfer member, whereby said multiple toner image is transferred to at least one face of said substrate;

heating means for heating said multiple toner image on said transfer member in advance of the transfer of said multiple toner image to said substrate; and cooling means for cooling said transfer member following the transfer of said multiple toner image therefrom to said substrate to a temperature below the glass transition temperature $T_g$ of the toner, prior to the deposition of further toner images on said transfer member.

2. The printer according to claim 1, wherein said transfer member is an intermediate transfer member, said printer further comprising:

a primary transfer member;

means for guiding said primary transfer member past a set of toner image producing stations whereby a plurality of toner images of different colours are formed on said primary transfer member in register with each other to form said multiple toner image on said primary transfer member, said intermediate transfer member being in contact with said primary transfer member downstream of said image producing stations, whereby said multiple toner image is electrostatically transferred from said primary transfer member to be deposited on said intermediate transfer member.

3. The printer according to any preceding claim, adapted for duplex printing, further comprising:

electrostatic deposition means for depositing a second multiple toner image on a second transfer member, said substrate feed means being adapted to feed a substrate along a substrate path into contact with said second transfer member, whereby said second multiple toner image is transferred to the opposite face of said substrate;

means for heating said second multiple toner image on said second transfer member in advance of the transfer of said second multiple toner image to said substrate; and means for cooling the second transfer member following the transfer of the second multiple toner image therefrom to the substrate to a temperature below the glass transition temperature $T_g$ of the toner, prior to the deposition of further toner images on said second transfer member.

4. The printer according to claim 3, wherein said second transfer member is a second intermediate transfer member, said printer further comprising:

a second primary transfer member;

means for guiding said second primary transfer member past a second set of toner image producing stations hereby a second plurality of toner images of different colours are transferred to said second primary transfer member in register with each other to form said second multiple toner image on said second primary transfer member, said second intermediate transfer member being in contact with said second primary transfer member downstream of said second set of image producing stations.

5. The printer according to claim 3, wherein the first and second transfer members are positioned in opposition to each other to form a transfer nip therebetween, through which the substrate path passes.

6. The printer according to claim 1, wherein said transfer member is positioned in opposition to a pressure roller to form a transfer nip therebetween, through which the substrate path passes.

7. The printer according to claim 6, wherein, downstream of said transfer nip, a glossing roller is positioned in opposition to said pressure roller to form a glossing nip through which said substrate passes.

8. The printer according to claim 1, wherein said transfer member is positioned in face-to-face pressure contact with a reaction surface to form a contact zone therebetween, extending continuously from an entrance to an exit, said heating means being positioned for heating said transfer member adjacent said entrance to a temperature above the glass transition temperature $T_g$ of the toner, and said cooling means being positioned for forcibly cooling said transfer member intermediate said entrance and said exit to a temperature below the glass transition temperature $T_g$ of said toner.

9. The printer according to claim 8, further comprising means for applying pressure between said transfer member and said reaction surface intermediate the entrance and exit.

10. The printer according to claim 8, further including second heating means for heating said transfer member adjacent said exit to a temperature above the glass transition temperature $T_g$ of said toner.

11. The printer according to claim 8, wherein both said transfer member and said reaction surface are impermeable.

12. The printer according to claim 8, wherein said cooling means comprises a cooling roller so positioned as to ensure more than tangential contact between the cooling roller and the transfer member.

13. The printer according to claim 8, wherein said reaction surface comprises a further transfer member, said further transfer member provided with:

further means for heating said further transfer member adjacent said entrance to a temperature above the glass transition temperature $T_g$ of the toner, and further means for forcibly cooling said further transfer member intermediate said entrance and said exit to a temperature below the glass transition temperature $T_g$ of said toner.

14. A method of single pass, multi-colour electrostatographic printing comprising the steps of:

moving a transfer member along a continuous path;

electrostatically depositing a plurality of toner images of different colours in powder form in register with each other onto said moving transfer member to form a charged multiple toner image thereon;

feeding a substrate along a substrate path into contact with said moving transfer member, whereby said multiple tone image is transferred to at least one face of said substrate;

heating said multiple toner image on said moving transfer member in advance of the transfer of said multiple toner image to said substrate; and cooling the moving transfer member following the transfer of the multiple toner image therefrom to the substrate to a temperature below the glass transition temperature $T_g$ of the toner, prior to the deposition of further toner images on said moving transfer member.

15. The method according to claim 14, further comprising the steps of:

feeding said substrate through a contact zone which extends continuously from an entrance to an exit thereof and is defined by said moving transfer member and a reaction surface in face-to-face pressure contact with said moving transfer member;

heating said moving transfer member adjacent said entrance to a temperature above the glass transition temperature $T_g$ of the toner; and forcibly cooling said moving transfer member intermediate said entrance and said exit to a temperature below the glass transition temperature $T_g$ of said toner.

16. The method according to claim 15, further comprising the step of applying pressure between said moving transfer member and said reaction surface intermediate said entrance and said exit.

17. The method according to claim 15, further comprising the step of heating said moving transfer member adjacent said exit of said contact zone to a temperature above the glass transition temperature $T_g$ of said toner.

18. The method according to claim 15, wherein said moving transfer member contacts said substrate with a dry surface.

19. The method according to claim 14, wherein said multiple toner image is heated to a temperature sufficient to reduce the viscosity thereof to less than 50 Pa s, said cooling of said moving transfer member being achieved while said substrate is in contact with said moving transfer member.

20. The method according to claim 19, wherein said multiple toner image is heated to a temperature of more than the glass transition temperature $T_g$, but below the degradation temperature of said toner.

21. The method according to claim 19, wherein said viscosity is in the range between 10 and 40 Pa s.

22. The method according to claim 14, wherein said toner images are formed of toner having a composition comprising a thermoplastic binder and from 10% to 50% by weight, based on the weight of the toner composition, of a pigment.

23. The method according to claim 14, wherein said toner images are formed of a toner composition in powder form, having a weight average particle size of between 0.5 μm and 5 μm.

24. The method according to claim 21, wherein said weight average particle size is between 1 μm and 4 μm.

25. A method for transferring a toner image in powder form from a transfer member to a substrate, comprising the steps of:

(1) heating said toner image to a temperature of more than the glass transition temperature $T_g$, but below the degradation temperature of said toner, sufficient to reduce the viscosity thereof to less than 50 Pa s;

(2) bringing said transfer member carrying said toner image into contact with said substrate;

(3) cooling said transfer member to a temperature below the glass transition temperature $T_g$ of the toner while said transfer member remains in contact with said substrate; and (4) thereafter separating said transfer member from said substrate, wherein said toner image is formed of a toner composition in powder form, having a weight average particle size of between 0.5 μand 5 μm.

26. The method according to claim 23, wherein said toner image is heated to more than 200° C.

27. The method according to claim 25, wherein said weight average particle size is between 1 μm and 4 μm.

28. A method for transferring a toner image in powder form from a transfer member to a substrate, comprising the steps of:

(1) heating said toner image to a temperature sufficient to reduce the viscosity thereof to less than 50 Pa s;

(2) bringing said transfer member carrying said toner image into contact with said substrate;

(3) cooling said transfer member to a temperature below the glass transition temperature $T_g$ of the toner while said transfer member remains in contact with said substrate; and (4) thereafter separating said transfer member from said substrate, wherein said toner image is formed of toner having a composition comprising a thermoplastic binder and from 10% to 50% by weight, based on the weight of the toner composition, of a pigment.

* * * * *

UNITED STATES PATENT AND TRADEMARK OFFICE

CERTIFICATE OF CORRECTION

PATENT NO. : 5,893,018
DATED : April 6, 1999
INVENTOR(S) : De Bock et al

It is certified that error appears in the above-identified patent and that said Letters Patent is hereby corrected as shown below:

Column 31, line 8, "claim 21," should read -- claim 23 --;

Column 31, line 25, "0.5$\mu$and" should read -- 0.5 $\mu$m and --.

Signed and Sealed this

Twentieth Day of June, 2000

*Attest:*

Q. TODD DICKINSON

*Attesting Officer*

*Director of Patents and Trademarks*